US010549415B2

(12) United States Patent
Hughes et al.

(10) Patent No.: US 10,549,415 B2
(45) Date of Patent: Feb. 4, 2020

(54) HANDLE ASSEMBLY FOR TROWEL

(71) Applicant: Marshalltown Company, Marshalltown, IA (US)

(72) Inventors: John T. Hughes, Fayetteville, AR (US); Charles H. Cowie, Fayetteville, AR (US)

(73) Assignee: Marshalltown Company, Marshalltown, IA (US)

( * ) Notice: Subject to any disclaimer, the term of this patent is extended or adjusted under 35 U.S.C. 154(b) by 243 days.

(21) Appl. No.: 15/482,244

(22) Filed: Apr. 7, 2017

(65) Prior Publication Data

US 2017/0291293 A1 Oct. 12, 2017

Related U.S. Application Data

(60) Provisional application No. 62/320,170, filed on Apr. 8, 2016.

(51) Int. Cl.
*B25G 1/10* (2006.01)
*E04F 21/16* (2006.01)

(52) U.S. Cl.
CPC ..... *B25G 1/102* (2013.01); *E04F 21/161* (2013.01)

(58) Field of Classification Search
CPC ..... B25G 1/102; B25G 1/10; Y10T 16/498; Y10T 16/476; E04F 21/161
See application file for complete search history.

(56) References Cited

U.S. PATENT DOCUMENTS

| | | | | |
|---|---|---|---|---|
| D67,685 | S | 6/1925 | Drew | |
| D70,942 | S | 8/1926 | Brown | |
| 1,967,479 | A | 7/1934 | Platts | |
| 1,989,225 | A | 1/1935 | Campbell | |
| 2,353,416 | A | 7/1944 | Silver | |
| 2,423,640 | A | 7/1947 | Daily | |
| 2,615,247 | A * | 10/1952 | Waters | B25G 3/14 279/104 |
| D295,013 | S | 4/1988 | Vosbikian | |
| D317,243 | S | 6/1991 | Everding et al. | |
| D346,946 | S | 5/1994 | Berti et al. | |
| D429,990 | S | 8/2000 | Kunkler | |
| 6,247,204 | B1 * | 6/2001 | Hamby | B25G 1/10 16/431 |
| 6,314,617 | B1 | 11/2001 | Hastings | |
| D462,003 | S | 8/2002 | Juhlin | |
| 7,621,023 | B2 * | 11/2009 | Pyatt | B25G 1/102 15/144.1 |

OTHER PUBLICATIONS

Marshalltown M/T19L12 19L Philadelphia Brick Trowel—Leather Handle 12 in, Feb. 4, 2014, 1 page.

* cited by examiner

*Primary Examiner* — Shay Karls
(74) *Attorney, Agent, or Firm* — Stinson LLP

(57) ABSTRACT

A handle assembly for a trowel. The handle assembly includes a handle body, and a grip mounted on and surrounding the handle body to provide a grip surface for a user of the trowel. The grip including a plurality of individual rings positioned end-to-end on the handle body. The grip and handle body are shaped and arranged for complementary mating engagement configured to inhibit rotation of the grip relative to the handle body.

20 Claims, 26 Drawing Sheets

HANDLE ASSEMBLY FOR TROWEL

FIELD

The present disclosure generally relates to a handle for a trowel.

BACKGROUND

Ergonomic trowel handles that are sufficiently robust for repeated use are difficult and/or expensive to manufacture on a consistent basis. Conventional trowel handles are made from machined wood. Quality can vary from handle to handle because undetected defects can be present in certain pieces of wood stock. These defects can lead to weak spots or uneven weight distribution in the manufactured handle.

BRIEF DESCRIPTION OF THE DRAWINGS

Corresponding reference characters indicate corresponding parts throughout the drawings.

DETAILED DESCRIPTION

Figure 1:
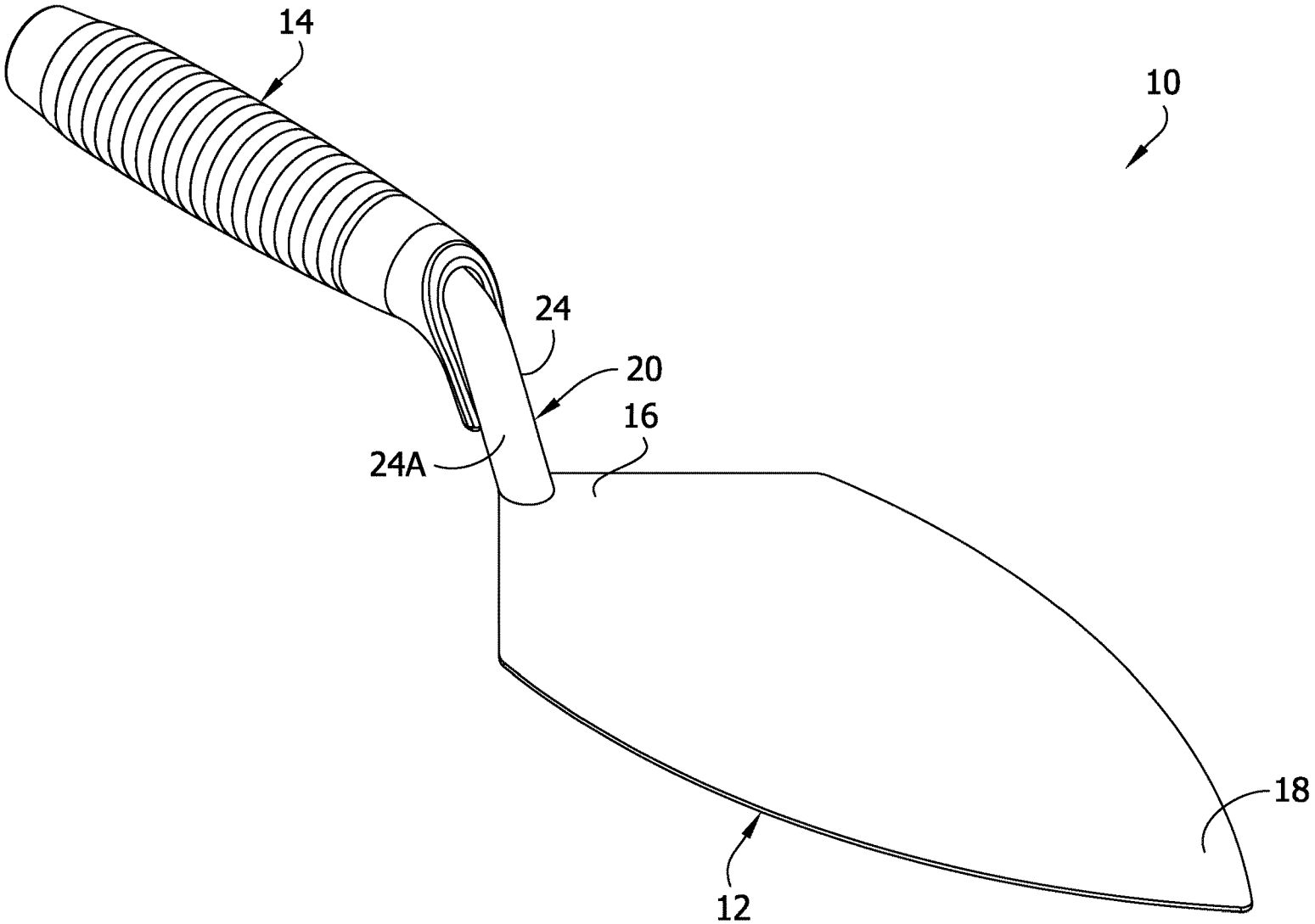
FIG. 1 is a perspective of a trowel.

Referring to FIGS. 1-4, a masonry trowel is generally indicated at 10. The illustrated trowel 10 is a London style brick trowel, but brick trowels of other kinds (e.g., Philadelphia style, wide London style, etc.) and other kinds of trowels (e.g., bucket trowels, concrete finishing trowels, corner trowels, gauging trowels, pointing trowels, pool trowels, step trowels, tile setters, tuck pointers, etc.) may also be used in other embodiments. The trowel 10 includes a blade 12 and a handle assembly 14. A suitable trowel blade 12 is generally shaped and arranged for manipulating (e.g., digging, leveling, spreading, shaping, etc.) viscous fluid or particulate material. The illustrated blade 12 is a sheet of suitably flexible steel that extends in a plane P, but other materials and shapes can be used in other embodiments. The blade 12 has a proximal heel portion 16 and a distal toe portion 18 spaced apart along a longitudinal axis of the blade. Side edges of the blade 12 taper inward to a pointed nose at the distal toe portion 18 of the blade. The side edges also taper as the heel portion 16 extends away from the toe portion.

Figure 2:
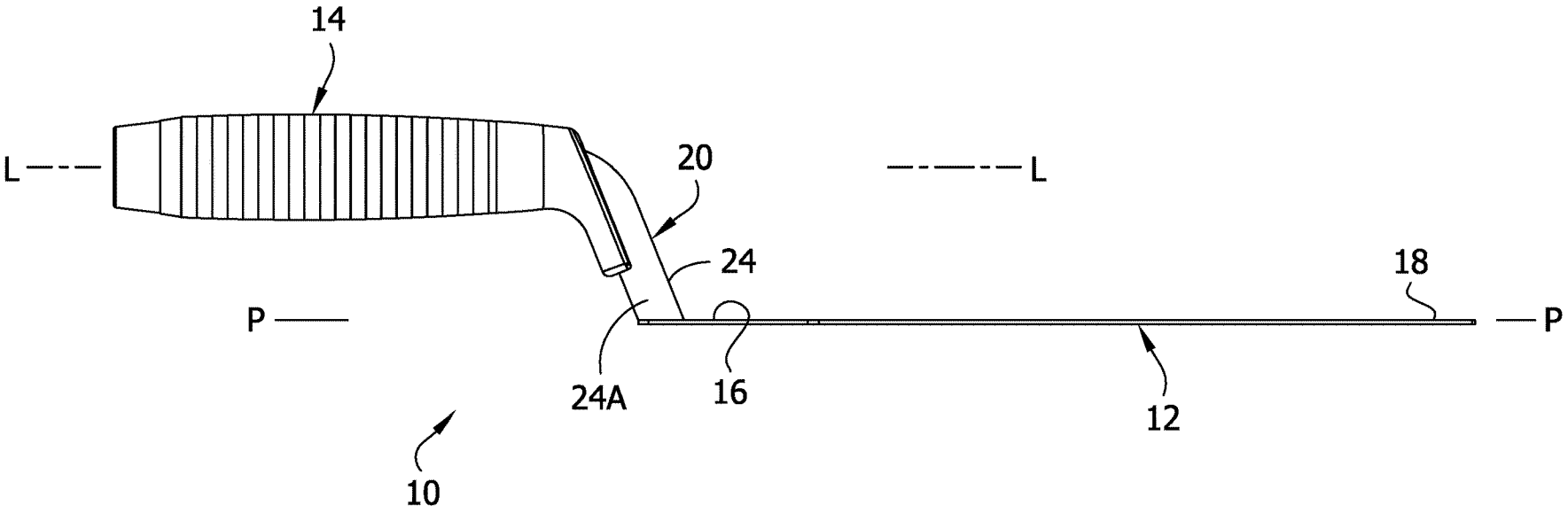
FIG. 2 is a side elevation of the trowel.
Figure 3:
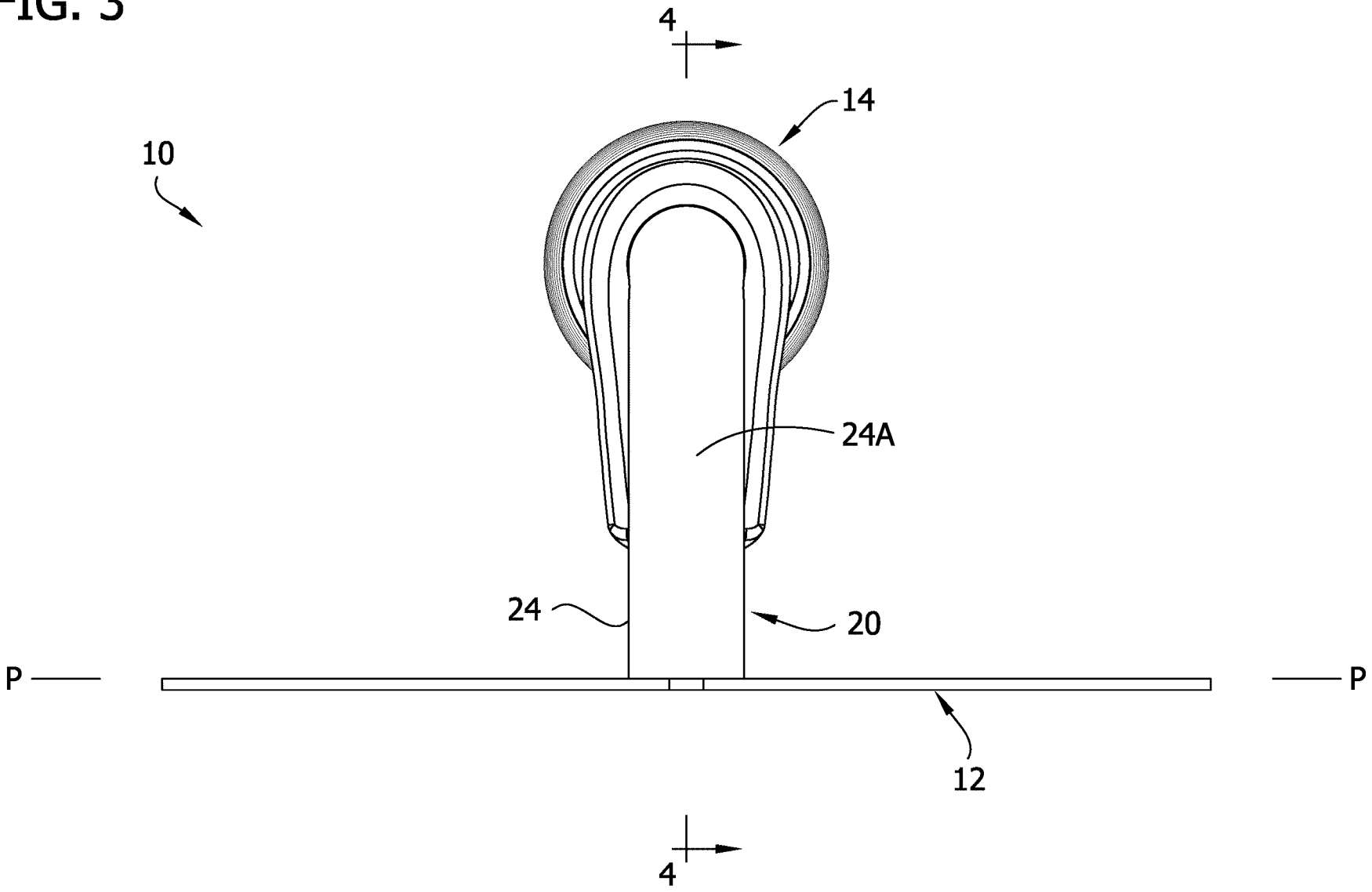
FIG. 3 is an end elevation of the trowel
Figure 4:
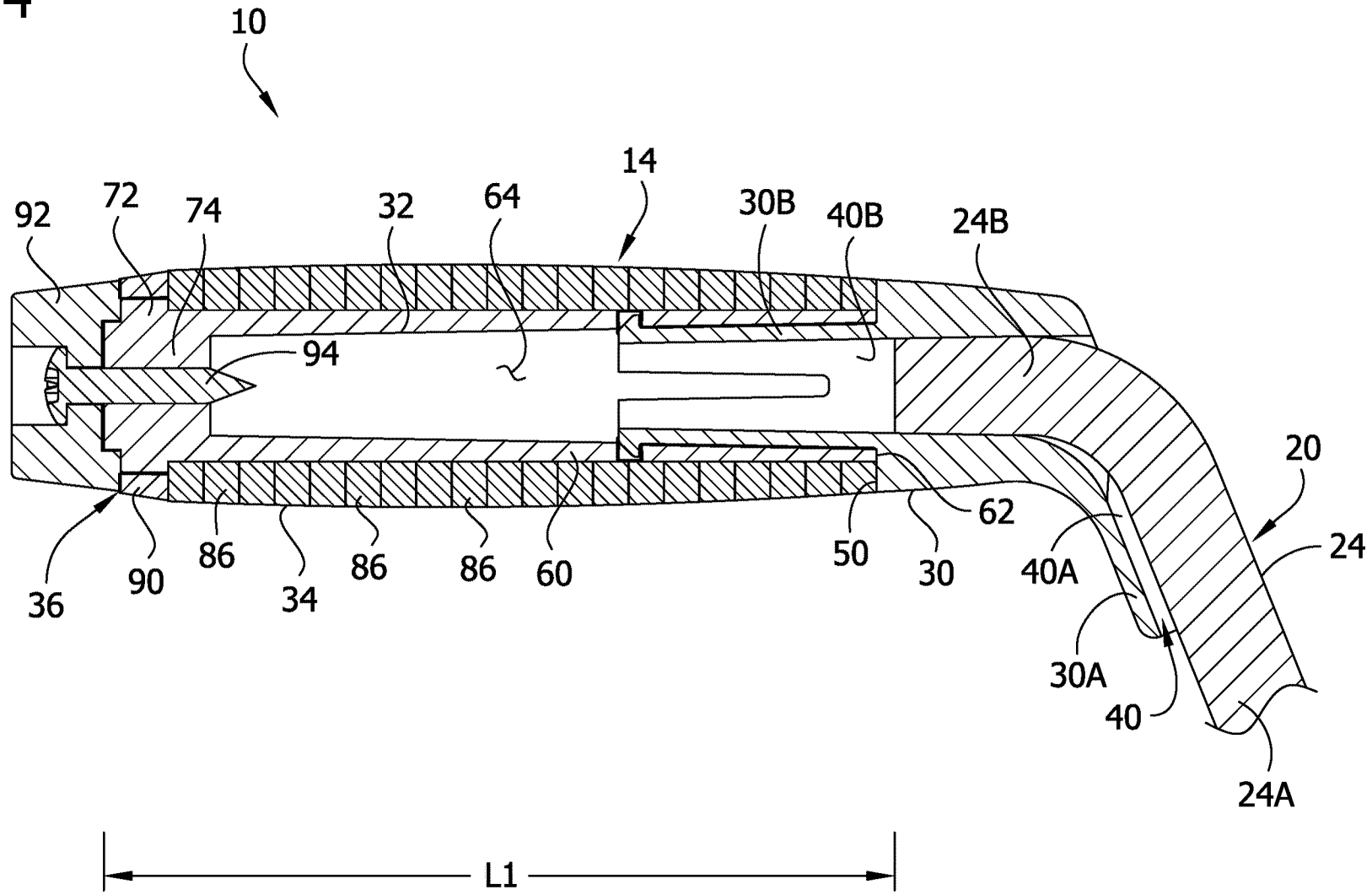
FIG. 4 is a fragmentary section taken in the plane of line 4-4 of FIG. 3.

A handle mount, generally indicated at 20, mounts the handle assembly 14 on the blade 12. The handle mount 20 suitably includes a shank 24 that extends upward from the heel portion 16 of the blade 12. The mount 20 can be joined to the blade 12 in any suitable manner. For example, the blade 12 and mount 20 can be forged together as one piece, or the mount can be separately attached to the blade by welding, riveting, etc. As shown in FIG. 4, the shank 24 includes an extension portion 24A and a handle connection portion 24B. The shank 24 is arranged so that the handle connection portion 24B extends transverse to the extension portion 24A. The extension portion 24A suitably extends away from the blade 12 at an obtuse angle, and the handle connection portion 24B extends generally proximally from the extension portion at an obtuse angle. As shown in the illustrated embodiment, the handle connection portion 24B can be oriented at an acute angle relative to the plane P of the blade 12 so that the mount 20 mounts the handle assembly 14 so that a longitudinal axis L thereof is oriented at a slightly offset angle from the plane of the blade as shown in FIG. 2.

Figure 5:
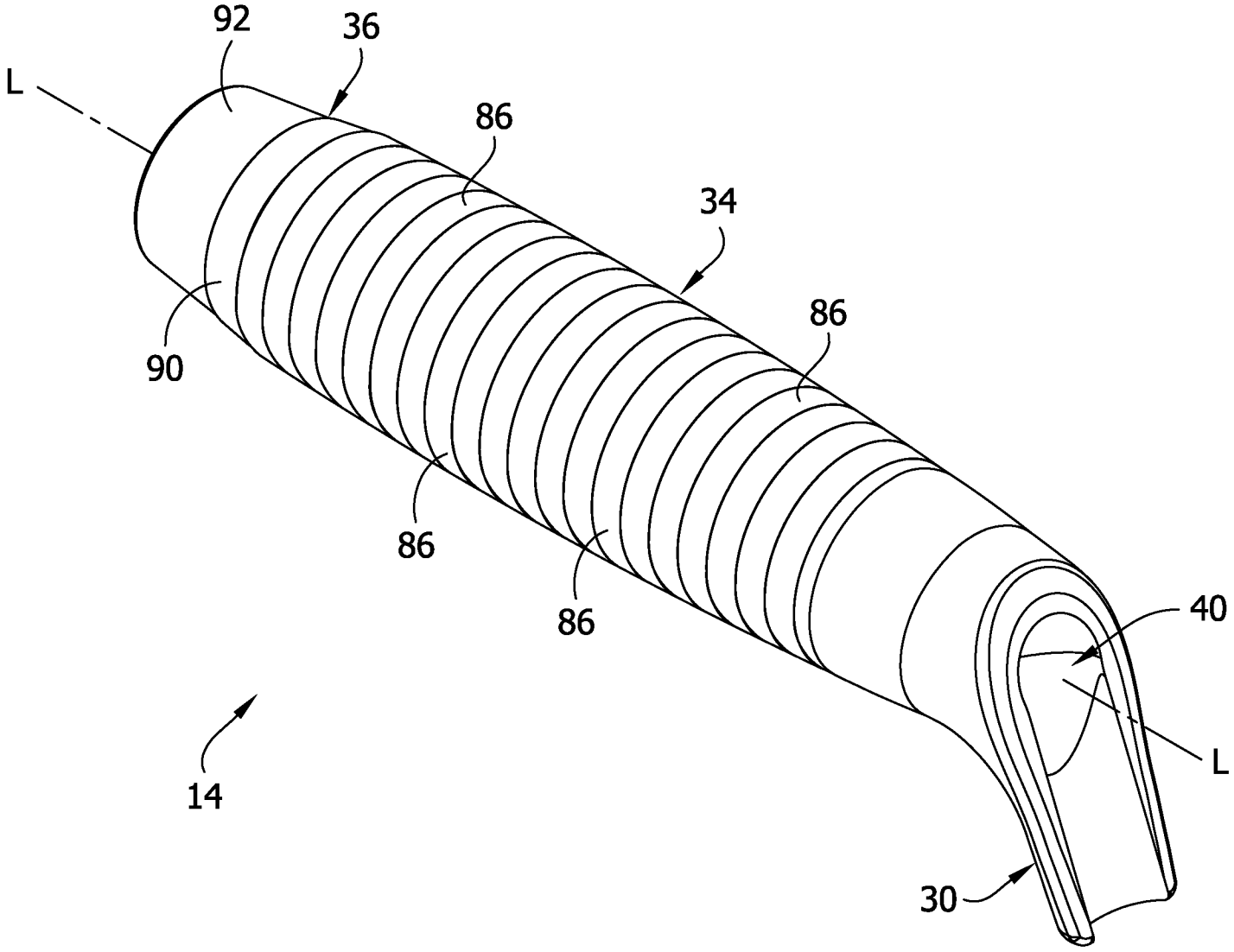
FIG. 5 is a perspective of a handle assembly of the trowel.
Figure 6:
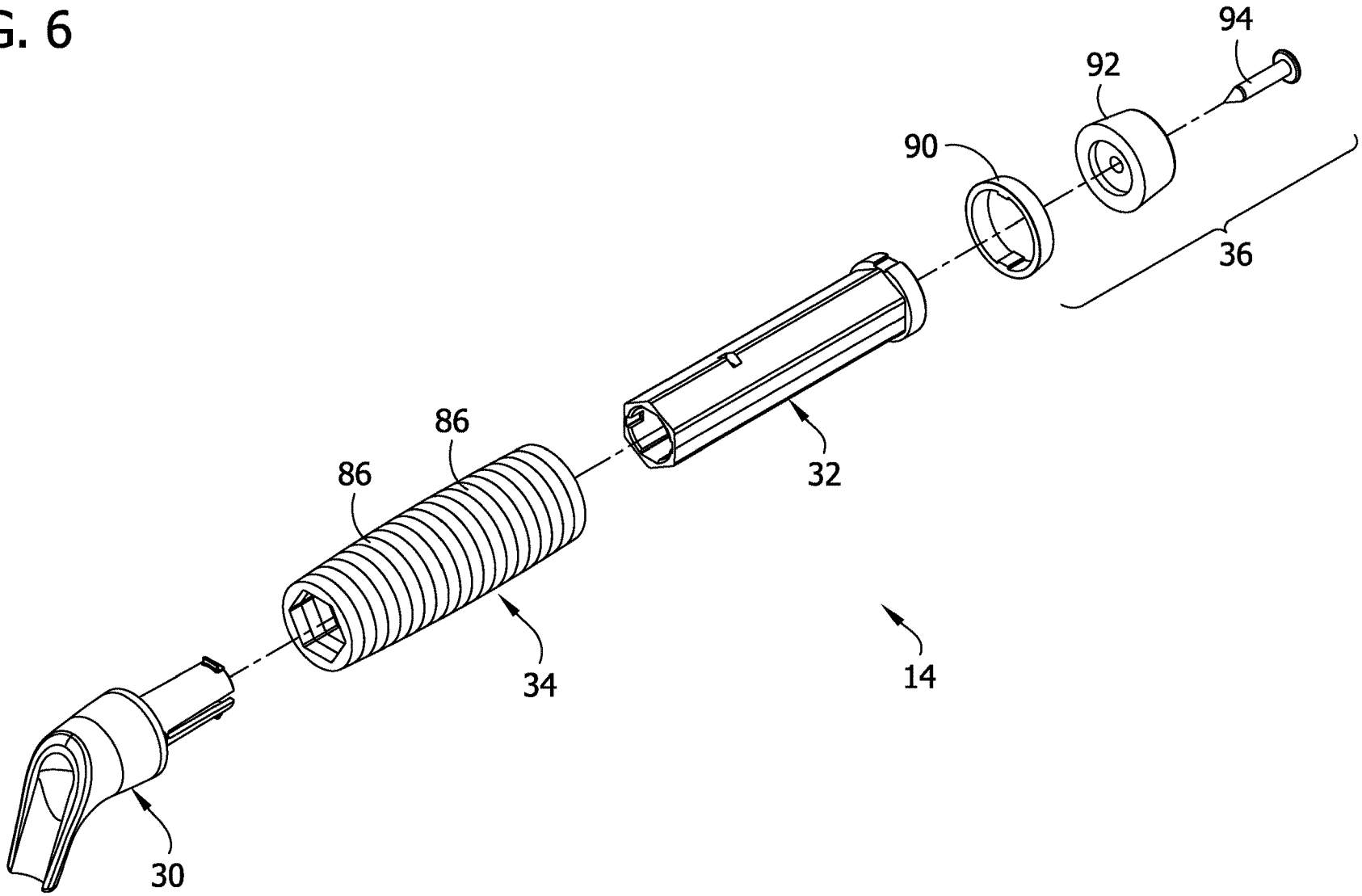
FIG. 6 is an exploded perspective of the handle assembly.

Referring to FIGS. 5 and 6, in one embodiment, the handle assembly 14 includes several components that are held together with interlocking components (e.g., snaps). The handle assembly 14 includes a nose member, generally indicated at 30, configured to mount the handle assembly on the handle mount 20. A handle body, generally indicate at 32 (FIG. 6), is configured to be attached to the nose member 30 and to support a grip, generally indicated at 34. As explained below, the grip 34 is secured to the handle body 32 between the nose member 30 and a bumper assembly 36, which provides a protective covering over the proximal end portion of the handle assembly 14. As will be apparent, the components of the handle assembly 14 are inexpensive to manufacture and form a handle that is both robust enough and comfortable enough for heavy and frequent use of the trowel 10 in demanding applications.

Figure 7:
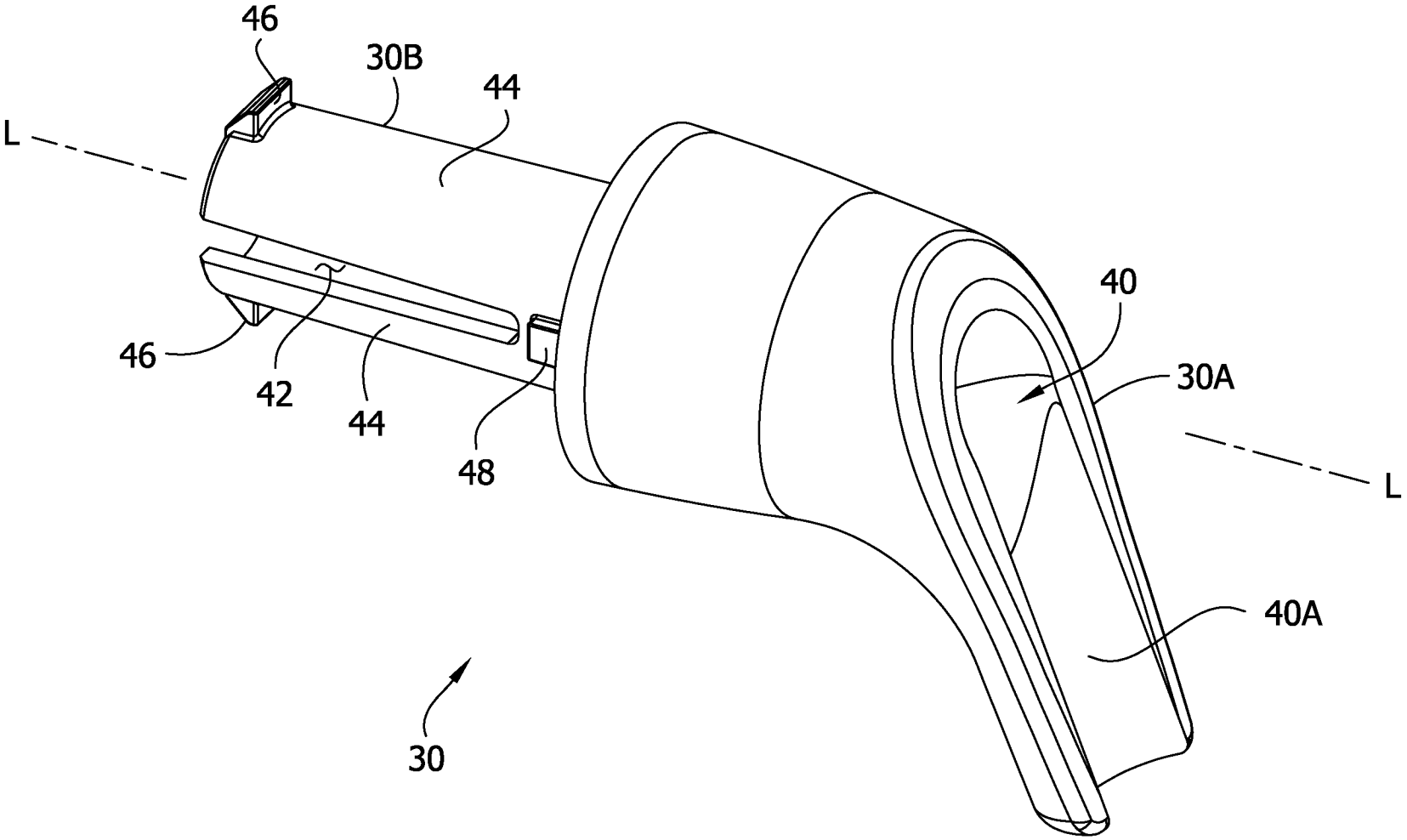
FIG. 7 is a perspective of a nose member of the handle assembly.
Figure 8:
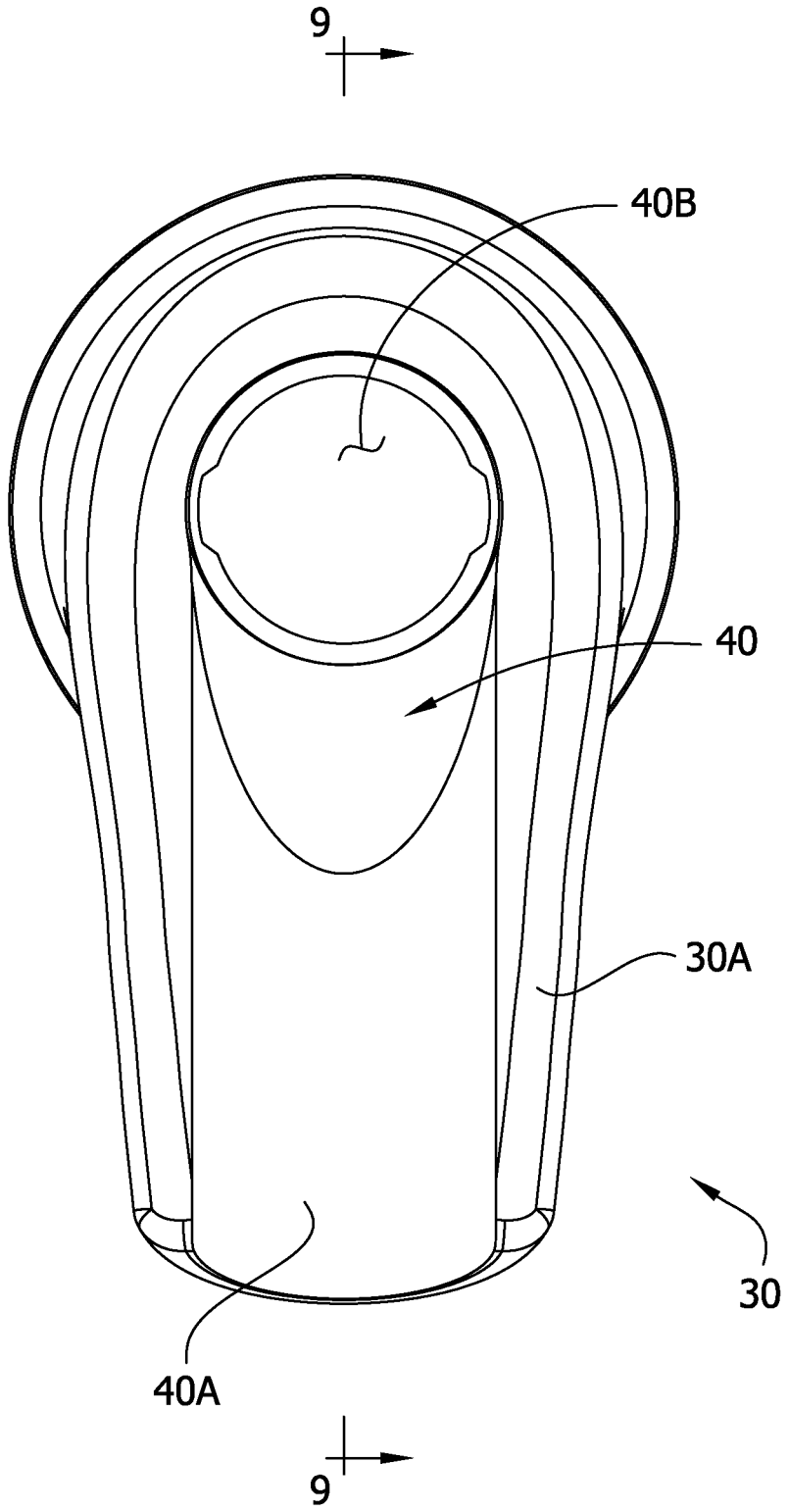
FIG. 8 is an end elevation of the nose member.
Figure 9:
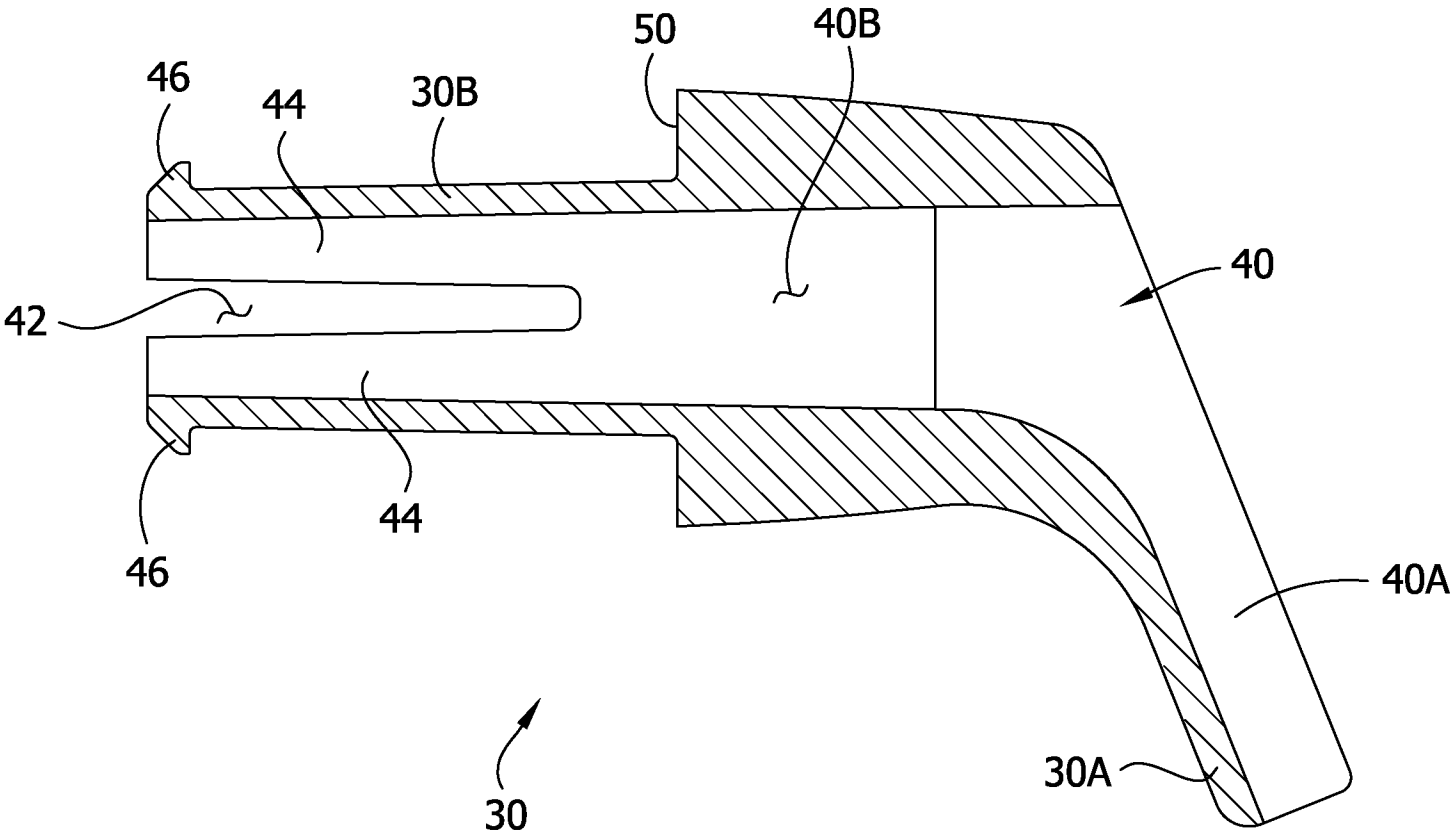
FIG. 9 is a section taken in the plane of line 9-9 of FIG. 8.

Referring to FIGS. 7-9, the nose member 30 is suitably formed from one unitary piece of material. For example, the nose member 30 can be formed of one piece of high strength plastic material (e.g., a fiber reinforced polymer, polypropylene, glass filled polypropylene, polyamide, glass filled polyamide, etc.). Suitable materials may have water resistance, chemical resistance, conductive properties, high strength, high hardness and/or elasticity. In other embodiments, the nose member 30 can be formed of metal, wood, ceramic, composite, or other high strength material. In a suitable embodiment, the nose member 30 is a molded part, such as an injection molded part. The nose member 30 can also be partially or fully formed in a machining process.

Referring still to FIGS. 7-9, the nose member 30 has a generally bent shape that includes a proximal end portion 30B that extends generally along the longitudinal axis L of the handle assembly 14, and a distal end portion 30A that extends generally downward from the proximal end portion. As shown in FIGS. 8 and 9, the nose member 30 defines a cavity, generally indicated at 40, for operatively receiving the shank 24 of the handle mount 20 to mount the handle assembly 14 on the blade 12. The cavity 40 includes a depression 40A formed in the distal end portion 30B of the nose member 30. The depression 40A extends generally along an upwardly and proximally extending depression axis through the distal end portion 30A of the nose member 30. The proximal end of the depression 40A opens to a passage 40B that extends generally along the longitudinal axis L of the handle assembly 14. As shown in FIG. 4, the cavity 40 is sized and arranged to receive the shank 24 therein.

In a suitable embodiment, the nose member 30 is sized and arranged so that the shank 24 is press fit in the nose member (e.g., to form a friction fit or an interference fit with the nose member) when it is received in the cavity 40. The press fit engagement of the two parts mounts the handle assembly 14 on the handle mount 20. The extension portion 24A of the shank 24 is press fit in the depression 40A to inhibit the nose member 30 from rotating relative to the handle mount 20 about the longitudinal axis L of the handle 14. More specifically, the distal end portion 30A of the nose member 30 extends circumferentially around and engages a proximal portion of the extension portion 24A to inhibit movement of the nose member relative to the mount 20 along an axis transverse to the longitudinal axis of the depression 40A. The distal end portion 30A also frictionally engages the extension portion 24A to inhibit translational movement along or rotational movement about the axis of the extension portion. The handle connection portion 24B is press fit in the passage 40B to inhibit the nose member 30 from moving along the longitudinal axis L. By extending around the proximal portion of the extension portion 24A, the distal end portion 30A of the nose member 40 forms a finger guard that is positioned between the shank 24 and a user's fingers in use. The finger guard 30A protects a user's fingers from uncomfortable direct engagement with the shank 24. The proximal end portion 30B of the nose member 30 extends circumferentially around the handle connection portion 24B to inhibit relative movement between the nose member and handle mount 20. The nose member 30 thereby frictionally engages the handle connection portion 24B to inhibit translational movement along or rotational movement about the axis L of the handle connection portion. In certain embodiments, the nose member 30 is mounted on the handle mount 20 in other ways. For example, the illustrated press fit connection could be supplemented or replaced with another attachment structure (e.g., an adhesive, a mechanical fastener, an integral material joint, such as electrofusion joint, a welded joint, a soldered joint, or a brazed joint, etc.).

The proximal end portion 30B of the nose member 30 is shaped and arranged for interlocking engagement with the handle body 32 to mount the handle body on the nose member. The proximal end portion 30B of the nose member 30 defines a plug that, as explained in further detail below, is configured to interlockingly mate with the handle body 32. In the illustrated embodiment, the plug 30B has a hollow, generally cylindrical shape that extends generally along the longitudinal axis L of the handle assembly 14. Slots 42 extend radially through and along the annular wall of the plug 30B to define circumferentially spaced apart fingers 44. In the illustrated embodiment, the nose member 30 includes two slots 42 that define two diametrically opposed fingers 44. Other numbers of slots and fingers can also be used in other embodiments. As explained below, the fingers 44 are configured to resiliently deflect radially inward as the distal end portion 30B of the nose member 30 is received in the handle body 32. The plug 30B broadly includes locking formations 46, 48 (e.g., detents or catches) for lockingly engaging the handle body 32 when the handle body is mounted on the nose member 30. In the illustrated embodiment, each locking formation 46 is a radially outwardly extending tab disposed at the proximal end portion of the respective finger 44. Each locking formation 48 is a radially outwardly extending tenon (broadly, a raised element) that is circumferentially aligned with a respective slot 42 and disposed generally at the distal end portion of the plug 30B. The nose member 30 also defines a generally axially facing stop 50 that extends radially outward from adjacent the distal end of the plug 30B.

Figure 10:
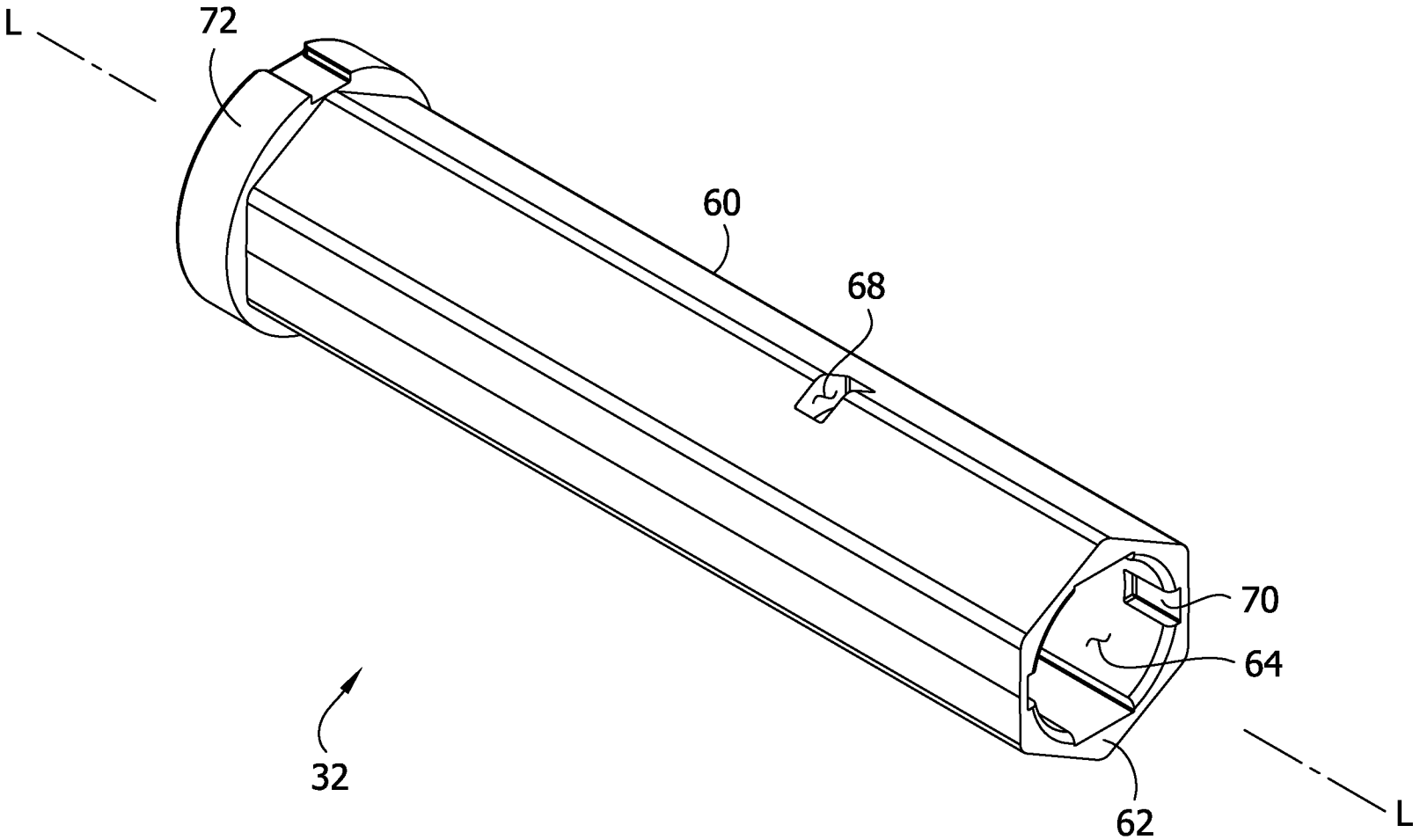
FIG. 10 is a perspective of a handle body of the handle assembly.
Figure 11:
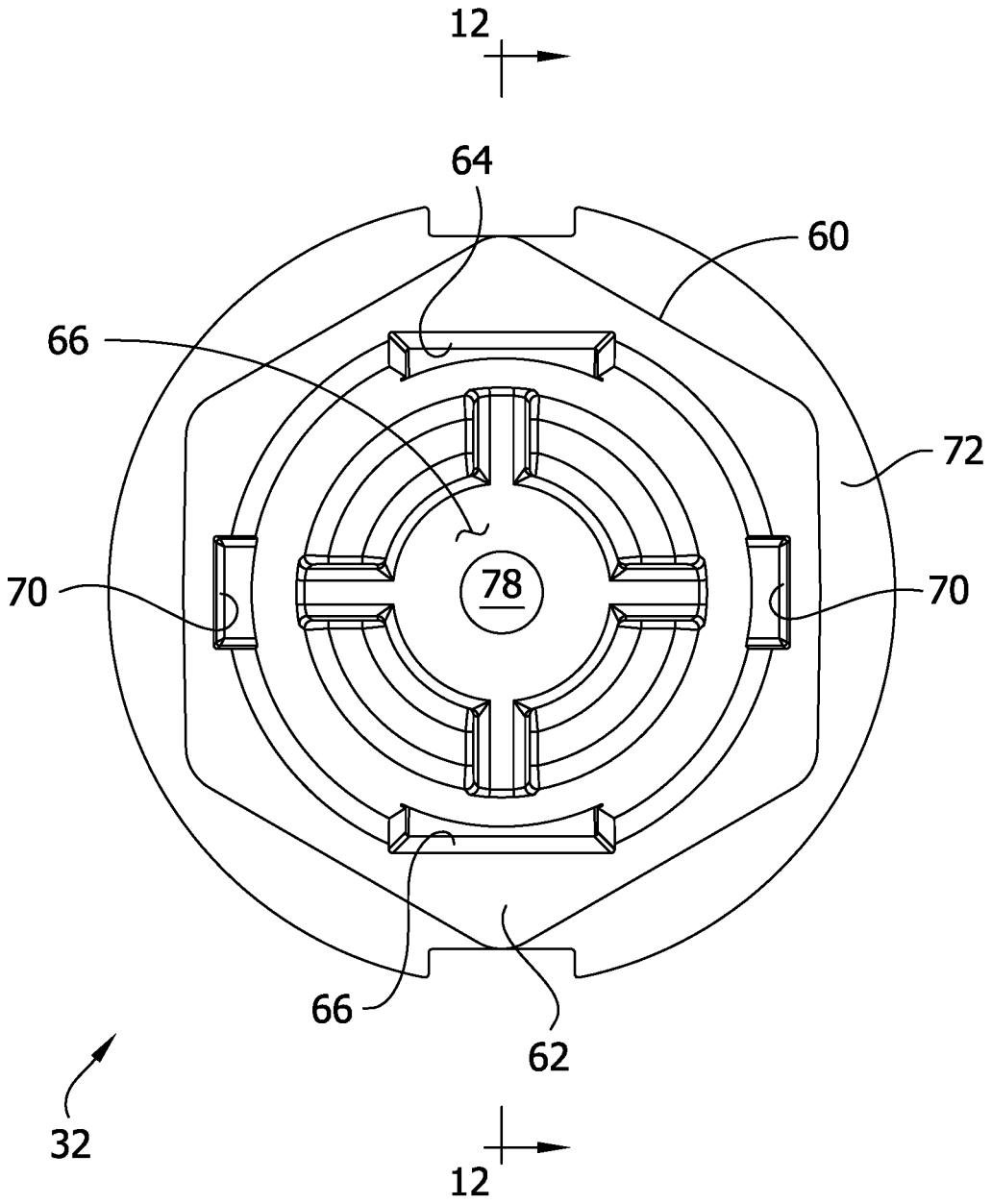
FIG. 11 is an end elevation of the handle body.
Figure 12:
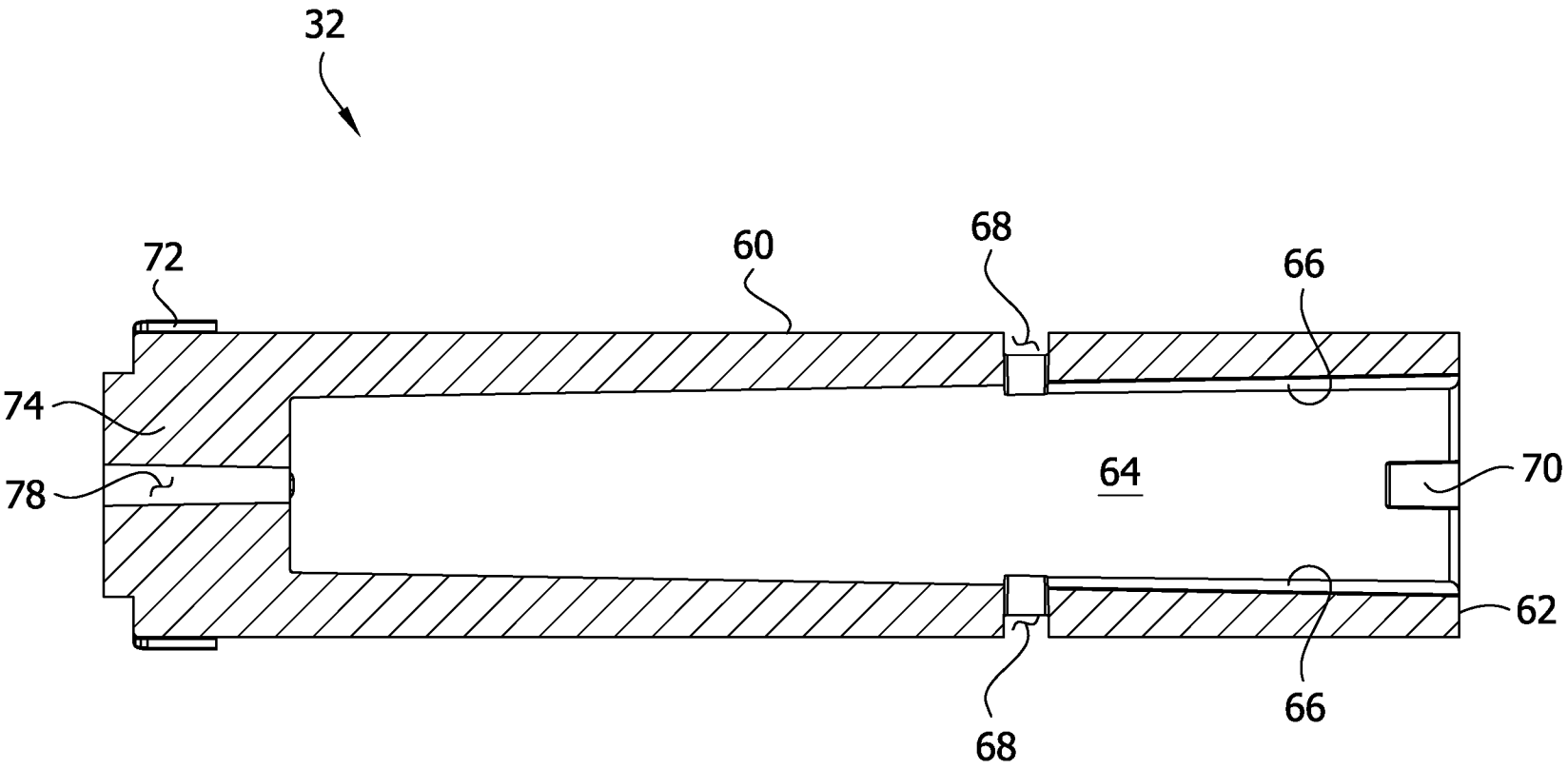
FIG. 12 is a section taken in the plane of line 12-12 of FIG. 11.

Referring to FIGS. 10-12, the handle body 32 extends generally along the longitudinal axis L of the handle assembly 14 from a proximal end portion to a distal end portion. In a suitable embodiment, the handle body 32 is formed from one unitary piece of material. For example, the handle body 32 can be formed of one piece of high strength plastic material (e.g., a fiber reinforced polymer, polypropylene, glass filled polypropylene, polyamide, glass filled polyamide, etc.). Suitable materials may have water resistance, chemical resistance, conductive properties, high strength, high hardness and/or elasticity. In other embodiments, the handle body can be formed of metal, ceramic, composite, or other high strength material. Suitably, the handle body 32 may be molded part, such as an injection molded part. The handle body 32 can also be partially or fully formed in a machining process.

The handle body 32 is shaped and arranged to lockingly mate with the nose member 30. The handle body 32 includes a grip support portion 60 that extends from a generally axially facing distal end surface 62 toward the proximal end. In the illustrated embodiment, the grip support portion 60 extends along the majority of the length of the handle body 32. The grip support portion 60 defines a socket 64 sized for matingly receiving the plug 30B. The grip support portion 60 is suitably sized and arranged so that the fingers 44 deflect radially inward as the plug 30B is inserted into the socket 64. For example, the diameter of the socket 64 can be slightly smaller than the diameter of the plug 30B so that the fingers 44 must deflect inward to fit the plug in the socket. When the plug 30B is fully inserted in the socket 64, the generally distal end surface 62 engages the stop 50 to prevent further insertion.

Referring still to FIGS. 10-12, the grip support portion 60 further defines circumferentially spaced apart grooves 66 and radially outwardly extending recesses 68 that are circumferentially aligned with the grooves. In the illustrated embodiment, the recesses 68 include two diametrically opposed apertures (FIG. 12) that extend radially through the outer surface of the grip support portion. The recesses 68 could extend only partially through the wall of the grip support portion 60 in other embodiments. The diametrically opposed grooves 66 extend radially outwardly through part of the thickness of the wall of the grip support portion 60 and extend axially along the longitudinal axis L of the handle body 32 from the distal end of the grip support portion to the recesses 68. It will be understood that other numbers and arrangements of grooves and recesses can be used in other embodiments. For example, suitable additional embodiments can define grooves 66 and recesses 68 that correspond in number and circumferential position with the tabs 46 of the plug 30B.

The grooves 66 are configured to receive the tabs 46 therein and guide insertion of the plug 30B into the socket 64 by maintaining the tabs in circumferential alignment with the grooves as the plug is being inserted. Thus, the grooves 66 broadly function as insertion guides that maintain circumferential alignment of the nose member 30 and handle body 32 during insertion. Other forms of insertion guides (e.g., tracks, rails, etc.) can be used in other embodiments.

When the plug 30B is fully inserted into the socket 62, the interlocking engagement of the nose member 30 and the handle body 32 inhibits relative movement of the two parts. More specifically, as the tabs 46 move into axial alignment with the recesses 68, the fingers 44 resiliently deflect radially outwardly so that the tabs are lockingly received in the recesses. The tabs 46 lockingly engage the grip support portion 60 to inhibit the nose member 30 and the handle body 32 from moving relative to one another along the longitudinal axis L or rotating relative to one another about the longitudinal axis L. Accordingly, the recesses 68 broadly function as locking formations for lockingly receiving the tabs 46 to lock the handle body 32 in place on the nose member 30.

In addition to the grooves 66 and recesses 68, the grip support portion 60 also defines mortices 70 (broadly, recesses, slots, or depressions), which likewise function as locking formations for lockingly receiving the tenons 48 to fix the handle body 32 in place on the nose member 30. In the illustrated embodiment, two mortices 70 extend radially outward into the grip support portion 60 at diametrically opposed locations and extend a short axial distance from the distal end of the handle body 32. Other numbers and arrangements of mortices can be used in other embodiments. Suitably, the number and arrangement of mortices correspond with the number and arrangement of tenons. In one or more embodiments, the mortices 70 can be shaped and arranged so that the grip support portion 60 conforms to the shape of the tenons 48 in a close tolerance fit (e.g., to form a press fit connection, a friction fit connection, and/or an interference fit connection). When the plug 30B is fully inserted in the socket 64, the tenons 48 mate with the mortices 70. As a result, the mating engagement of the tenons 48 and the mortices 70 inhibits movement of the handle body 32 relative to the nose member 30.

The handle body 32 is shaped and arranged to support the grip 34. The outer surface of the grip support portion 60 is configured to radially support the grip 34 when the grip is received on the handle body. In the illustrated embodiment, a flange portion 72 of the handle body 32 defines the distal end of the grip support portion 60. Suitably, the outer surface of the grip support portion 60 is polygonal in cross-sectional shape. As shown in FIG. 11, the outer surface of the illustrated grip support portion 60 has a hexagonal cross-sectional shape, but other polygonal shapes (e.g., triangle, square, pentagon, octagon, etc.) may also be used without departing from the scope of the invention. As will be explained in further detail below, the polygonal shape of the outer surface of the grip support portion 60 is configured to inhibit rotation of the grip 34 relative to the handle body 32. Thus, the outer surface of the grip support portion 60 is broadly shaped and arranged to inhibit rotation of the grip 34 relative to the handle body 32 as explained below. Other formations for shaping and arranging a grip support portion of a handle body to inhibit rotation of a grip relative to the handle body (e.g., splines, detents, grooves, etc.) can also be used in other embodiments.

As shown in FIG. 12, the handle body 32 further includes a proximal end wall 74. The proximal end wall 74 extends radially inward from adjacent the proximal end of the grip support portion 60. A screw passage 78 extends along the longitudinal axis L through the proximal end wall 74. As will be discussed in further detail below, the screw passage 78 is shaped and arranged for securing the bumper assembly 36 to the handle body 32 using a mechanical fastener. The end wall 74 and post 76, therefore, function broadly as a bumper mount for mounting the bumper assembly 36 on the handle assembly 14.

Figure 13:
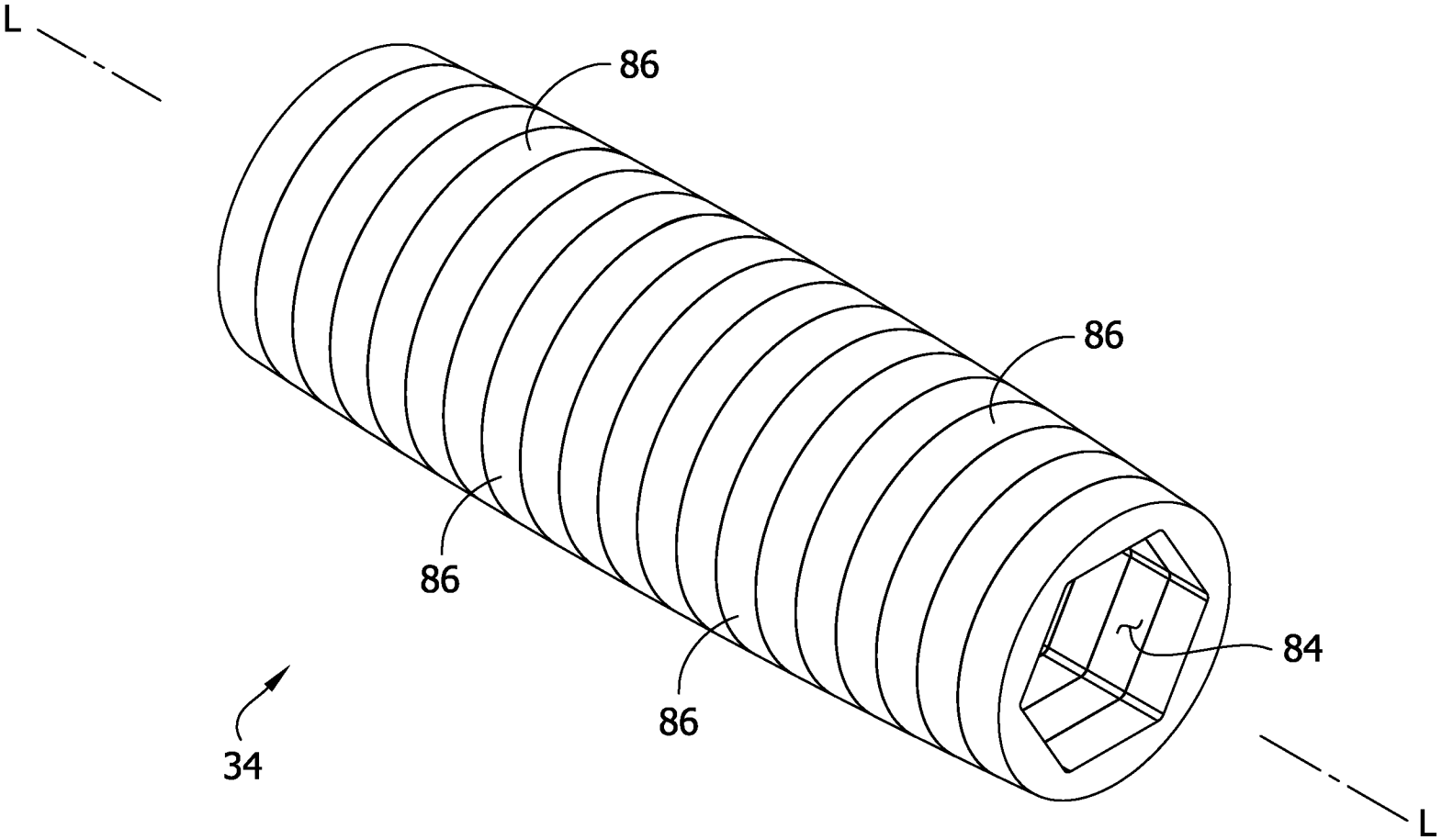
FIG. 13 is a perspective of a grip of the handle assembly.
Figure 14:
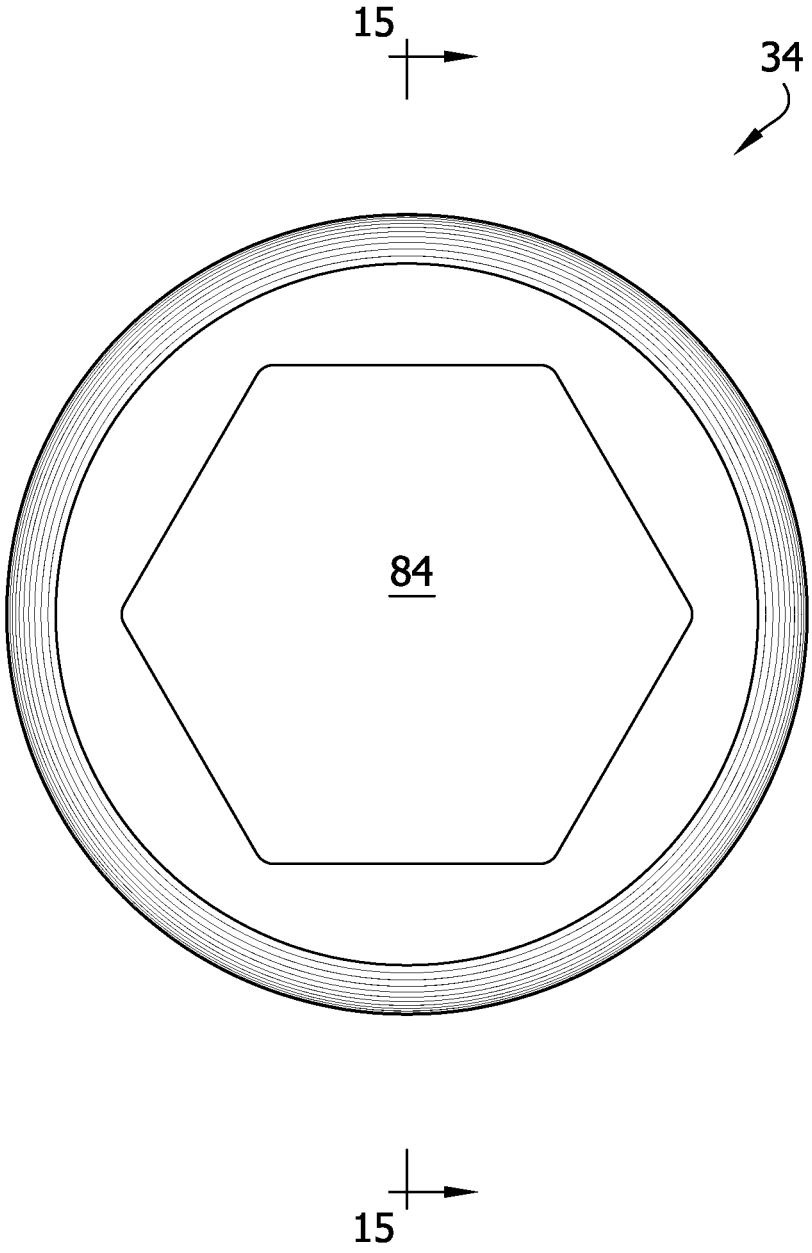
FIG. 14 is an end elevation of the grip.
Figure 15:
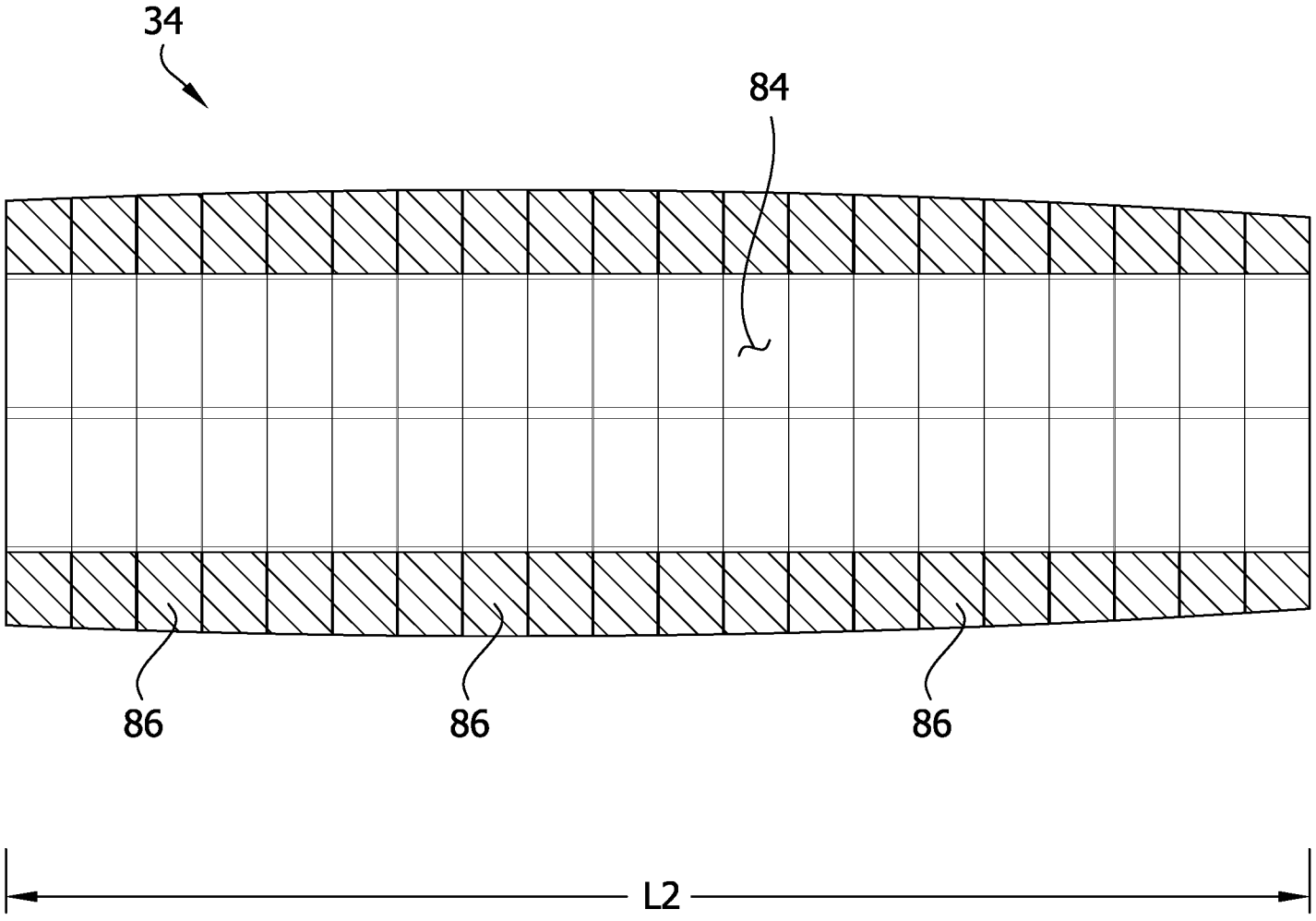
FIG. 15 is a section taken in the plane of line 15-15 of FIG. 14.
Figure 16:
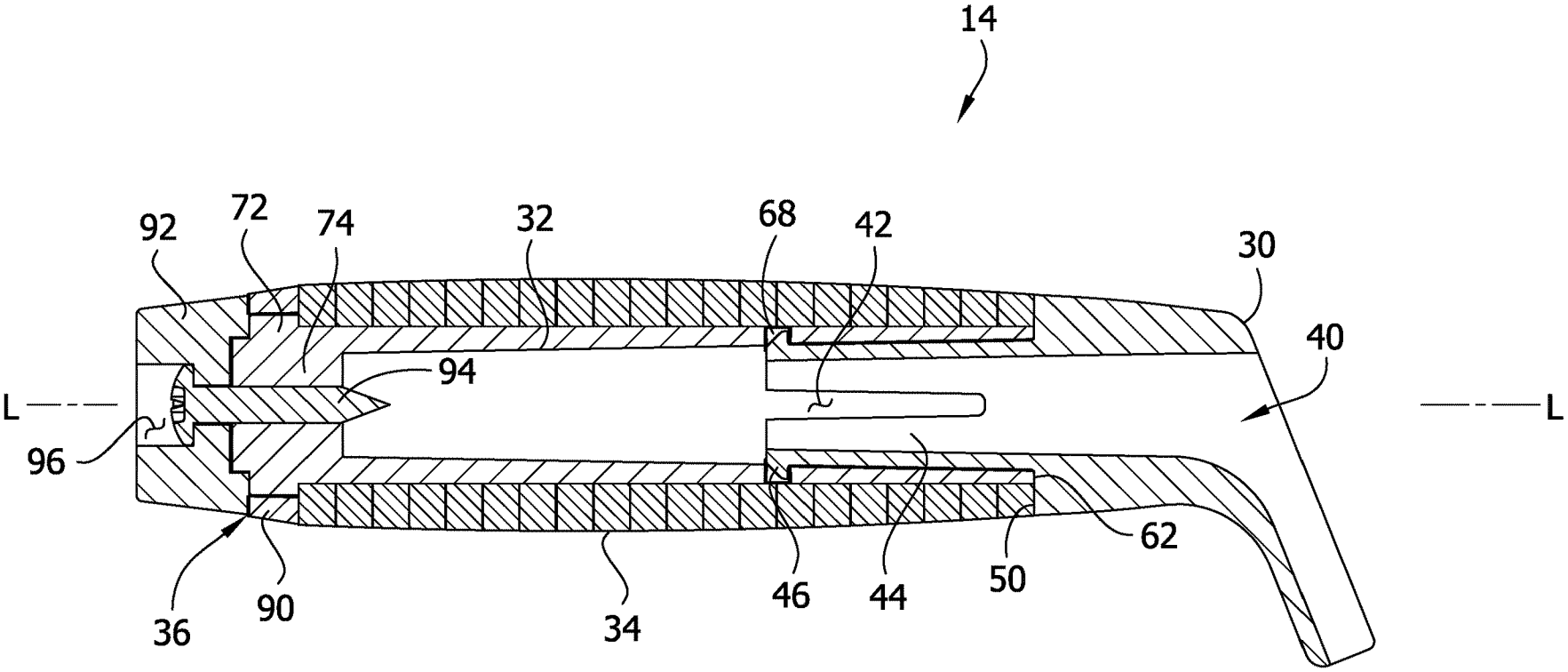
FIG. 16 is a section similar to FIG. 15, illustrating the grip mounted on the handle body.
Figure 17:
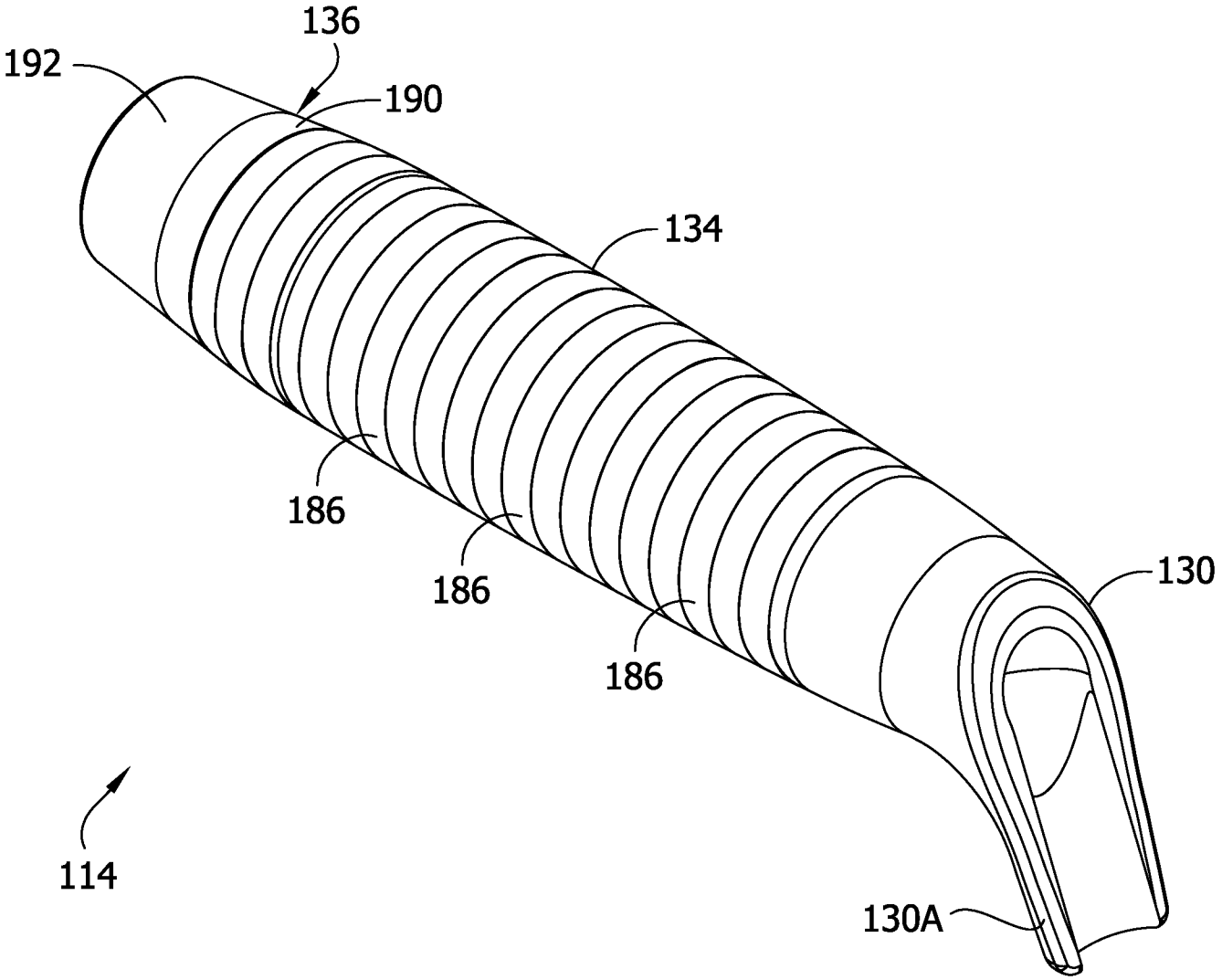
FIG. 17 is a perspective of another handle assembly.
Figure 18:
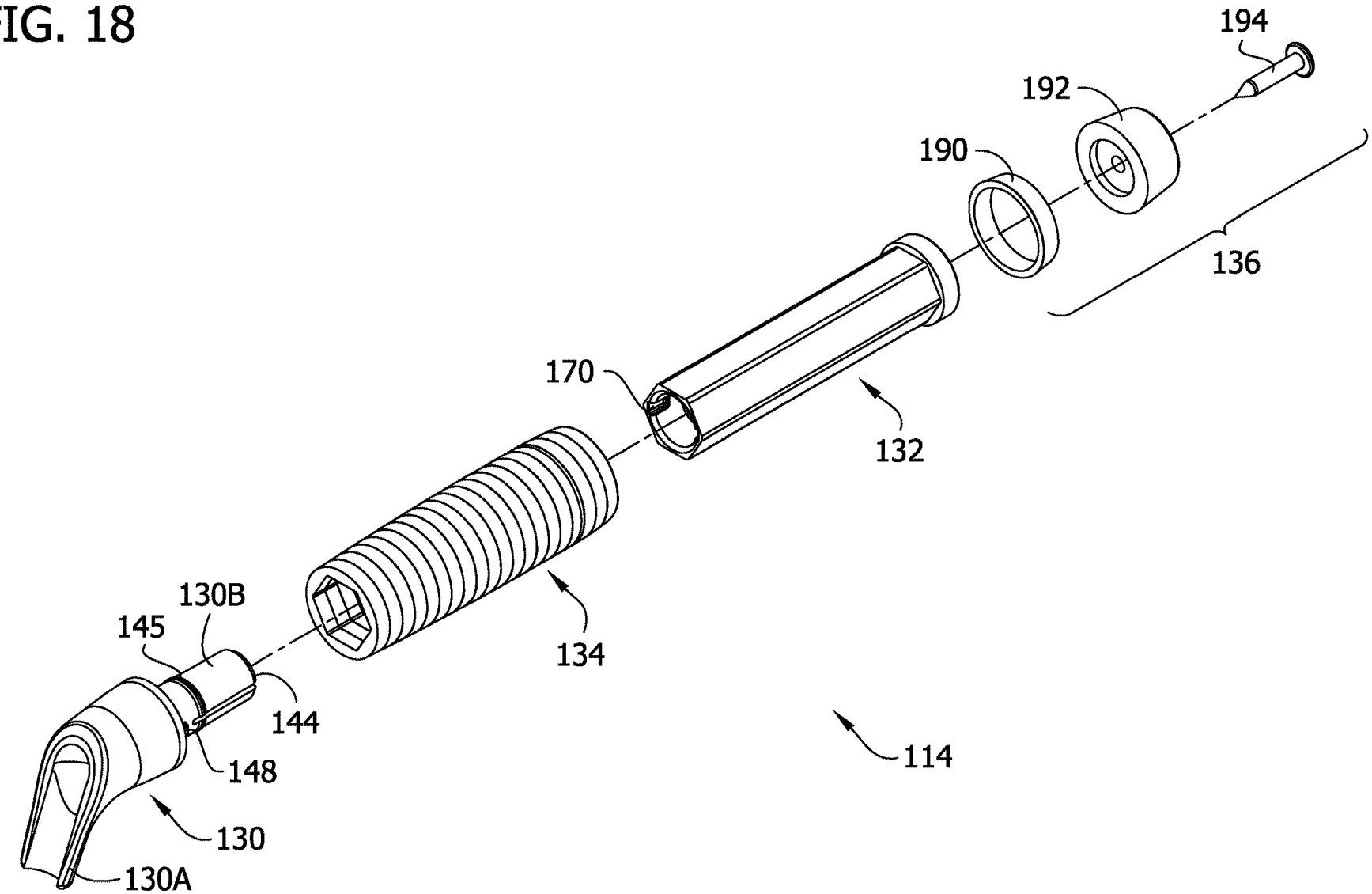
FIG. 18 is an exploded perspective of the handle assembly of FIG. 17.
Figure 19:
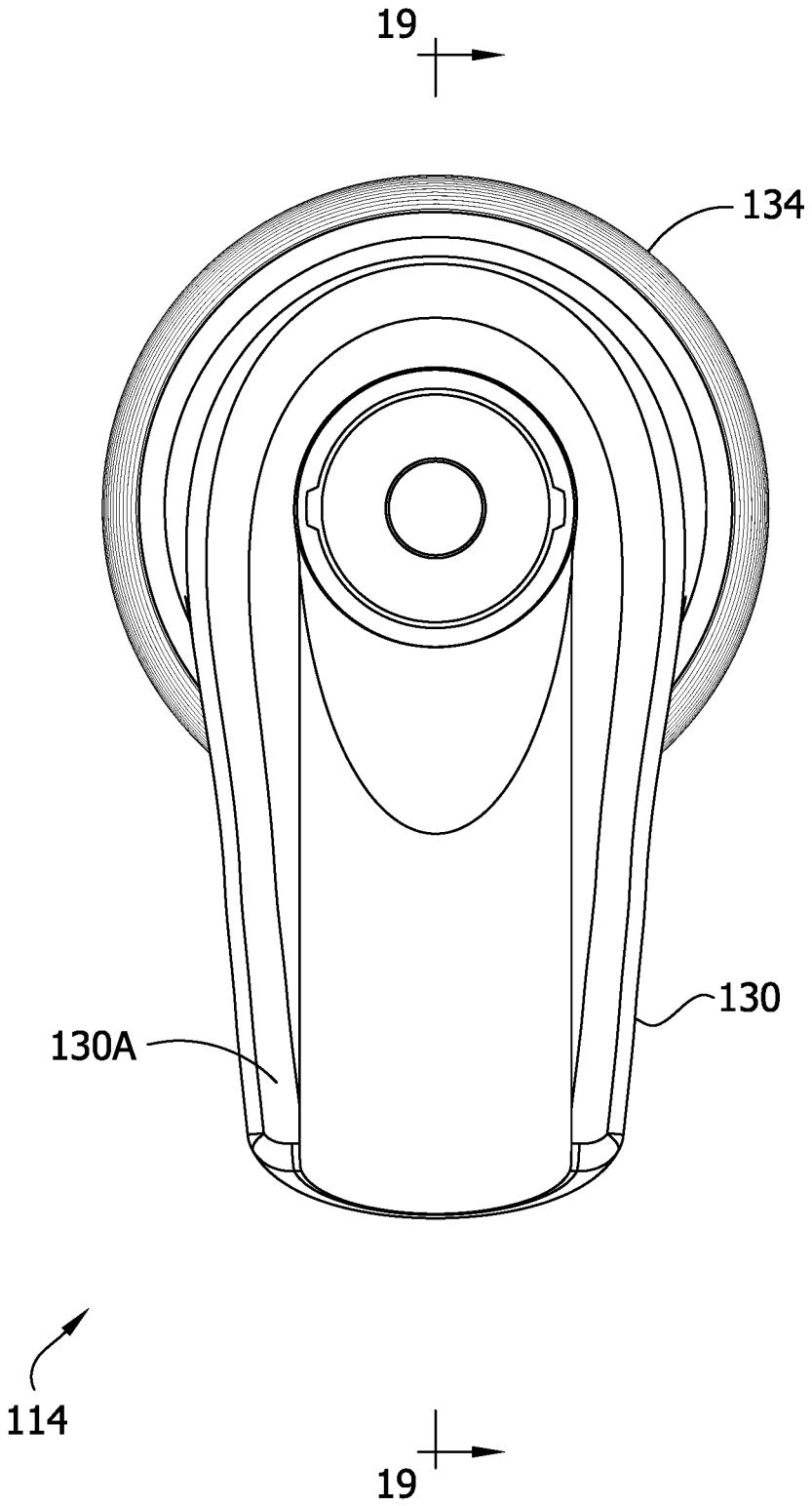
FIG. 19 is an end elevation of the handle assembly of FIG. 17.
Figure 20:
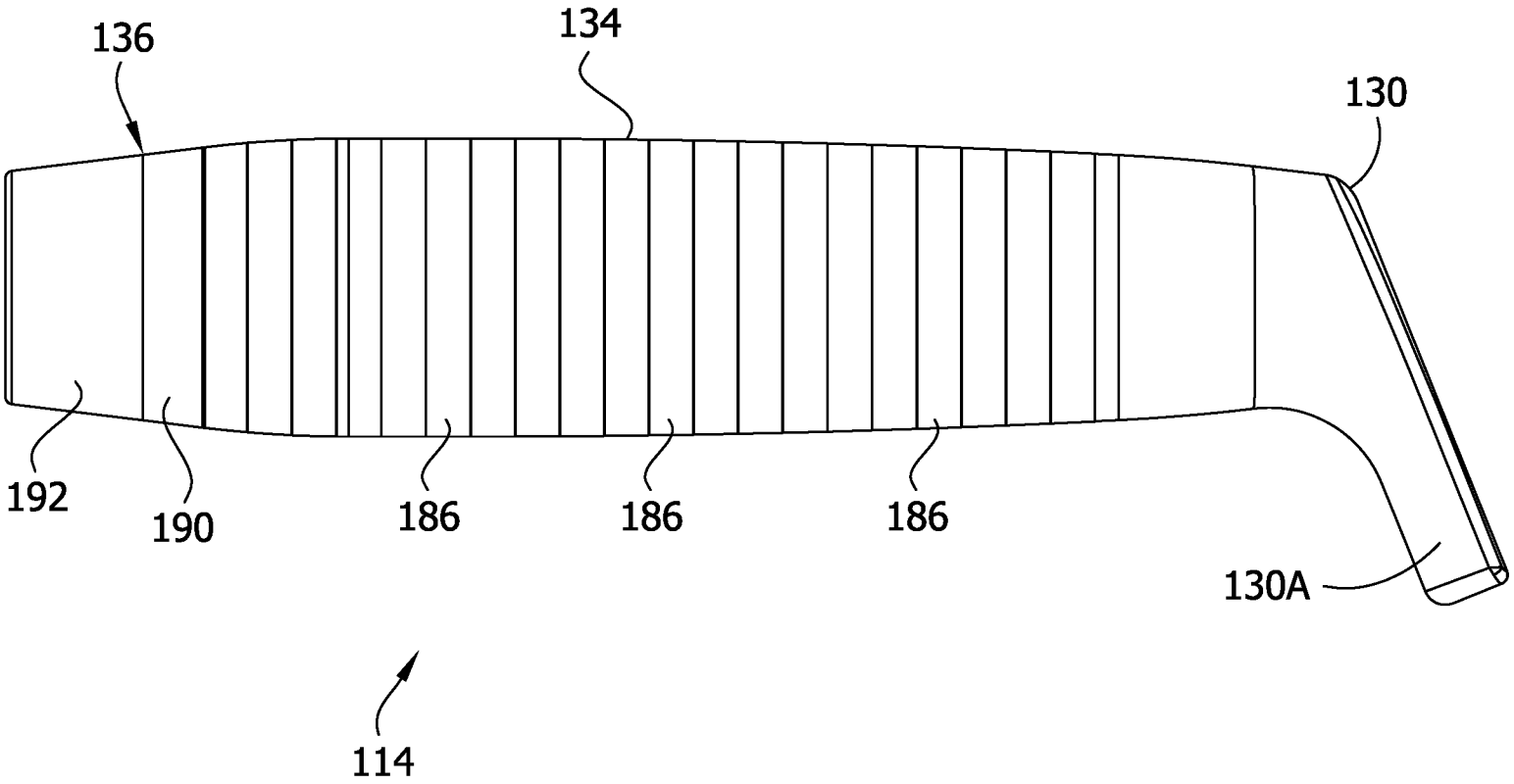
FIG. 20 is a side elevation of the handle assembly of FIG. 17.

Referring to FIGS. 13-15, the grip 34 is suitably arranged for being mounted on the handle body 32. In the illustrated embodiment, the grip 34 has a hollow generally cylindrical shape that extends generally along the longitudinal axis L and defines a passage 84 that extends generally along the longitudinal axis from the proximal end through the distal end of the grip. The grip 34 is configured to be installed on the handle body 32 by inserting the grip support portion 60 through the passage 84. An inner surface of the grip 34, which defines the passage 84, generally conforms to the outer surface of the grip support portion 60. Thus, the inner surface of the grip 34 is broadly shaped and arranged for mating engagement with the handle body 32 configured to inhibit rotation of the grip relative to the handle body. As shown in FIG. 16, the illustrated inner surface has a polygonal (e.g., hexagonal) cross-sectional shape that conforms to the polygonal cross sectional shape of the outer surface of the grip support portion 60. But in other embodiments the inner surface of the grip can define other formations for complementary engagement with a mating formation of the handle body to inhibit relative rotation of the grip and handle body. The outer surface of the illustrated grip 34 is contoured such that it gradually protrudes radially outwardly as it extends inward from its proximal and distal ends. The contoured outer surface defines an ergonomic shape that is comfortable when gripped by the hand of a user.

In the illustrated embodiment, the grip 34 comprises a plurality of rings 86 arranged end-to-end along the longitudinal axis L. Each ring 86 has a rounded outer surface and a polygonal inner surface that conforms to the polygonal outer surface of the handle body 32. The rings are arranged so the rounded outer surfaces define the contoured outer surface of the grip 34. Suitably, the rings can be formed of leather. Other gripping materials can also be used. Suitable gripping materials are somewhat elastically compliant when gripped and resistant to wear with repeated gripping. (e.g., a fiber reinforced polymer, polypropylene, glass filled polypropylene, polyamide, glass filled polyamide, etc.). Suitable gripping materials may have water resistance, chemical resistance, conductive properties, high strength, high hardness, high coefficient of friction under wet conditions, and/or elasticity. In addition to leather, other exemplary gripping materials include cork, rubber, plastic, metal, and/or composite materials. Although the illustrated grip 34 comprises a plurality of rings 86, it will be understood that other grips can be made of one piece of material or multiple pieces of material arranged in other ways.

As shown in FIG. 4, the grip 34 is configured to be mounted on the handle body 32 so that the axial ends of the grip engage the stop 50 of the nose member 30 and the flange portion 72 of the handle body. Thus, the stop 50 and flange portion 72 broadly function as axial grip supports for engaging the axial ends of the grip 34. As explained in further detail below, the bumper assembly 36 also defines an axial grip support that is aligned with the flange portion 72 in the illustrated embodiment. When the handle body 32 is mounted on the nose member 30, the stop 50 and flange portion 72 define an axially extending annular gap for receiving the grip 34 that has a length L1. Referring to FIG. 15, the grip 86 has a length L2 when no axial forces are imparted on the grip. Suitably, L2 is greater than L1 so that the grip 34 is held in axial compression between the stop 50 and flange portion 72 (broadly, axial grip support surfaces) when the grip is mounted on the handle assembly 14. Holding the grip 34 in axial compression causes the grip to constrict more tightly around the grip support portion 60 to more securely fasten the grip to the handle body 32.

Referring to FIGS. 4 and 16, the bumper assembly 36 is mounted on the handle body 32 to provide deformable material at the proximal end portion of the handle assembly 14, since a user often engages the proximal end portion of the handle assembly with the hand when imparting axial forces on the trowel 10. In the illustrated embodiment, the bumper assembly 36 includes a spacer ring 90, a bumper member 92, and a screw 94. The spacer ring 90 is received over the proximal end portion of the handle body 32. In the illustrated embodiment, the spacer ring 90 is sized and shaped for being mounted on the flange portion 72 of the handle body 32. The distal axial end of the spacer ring 90 forms a grip support surface that engages the proximal axial end of the grip 34. The bumper 92 suitably comprises a resiliently deformable material, such as a rubberized material. A distal axial end of the bumper 92 engages the spacer ring and forces the spacer ring 90 into contact with the proximal end of the grip 34. The distal axial end of the bumper 92 defines a proximally extending recess that receives a proximal end portion of the handle body 32 that protrudes proximally of the flange portion 72. A countersunk hole 96 extends axially through the bumper in alignment with the screw passage 78. The screw 94 extends through the hole 96 so that the head of the screw is recessed into the hole so as not to interfere with the hand of a user gripping the bumper member 92. The screw 94 is threaded into the proximal end wall 74 (broadly, the bumper mount) to secure the bumper member 92 to the handle body 32. Suitably the screw 94 holds the bumper member 92 in compression against the proximal end portion of the handle body 32. In addition, the screw 92 can urge the bumper member 92 into contact with the spacer ring 90 to press the spacer against the grip 34.

In use a user grips the handle assembly 14 to move the trowel blade 12 and thereby manipulate material in the desired manner. The nose member 30 securely mounts the handle assembly 14 on the handle mount 20 by press fit connection to inhibit the handle assembly from moving relative to the blade 12. The nose member 30 also protects a user's fingers from direct engagement with the shank 24 of the mount 20. The mating interlocking formations of the nose member 30 and handle body 32 lock the two components in place so that the handle assembly 14 and trowel feel secure in the user's hand. Likewise, the mating shapes of the grip 34 and handle body 32 prevent rotation of the grip about the handle body, which ensures a solid connection between the grip 34 and trowel blade 12 that enhances the responsiveness of the trowel 10. The compressive forces the nose member 30, the handle body 32, and the spacer ring 90 (broadly, the axial grip supports) impart on the grip 34 maintain a secure connection between the grip and the handle body. Furthermore, the bumper assembly 36 provides a comfortable and durable structure for gripping or impacting the proximal end of the handle assembly 14.

As can be seen, therefore, the handle assembly 14 provides a robust and comfortable structure for manipulating the trowel 10. Because each component of the handle assembly 14 can be manufactured using inexpensive techniques and materials, the handle assembly is inexpensive to manufacture. Furthermore, the materials and constructions of the individual components allow them to be manufactured with tight tolerances. As a result, the handle assemblies can be produced with little variance from handle to handle.

Referring to FIGS. 17-21, another embodiment of a handle assembly suitable for being mounted on the trowel blade 12 is generally indicated at 114. The handle assembly 114 is similar in many respects to the handle assembly 14. Corresponding features are given corresponding reference numbers, plus 100. Like the handle assembly 14, the handle assembly 114 includes a nose member 130, a handle body 132, a grip 134, and a bumper assembly 136 comprising a spacer ring 190, a bumper member 192, and a screw 194. As above, the nose member 130 is configured to mount the handle body 132 on the mount 20 of the trowel 10, the grip 134 is configured to be mounted on the handle body to inhibit rotation relative to the handle body, and the screw 102 is configured to be threadably received in a bumper mount 174 of the handle body to secure the bumper member 192 and spacer ring 190 to the handle assembly 114. As explained below, however, the nose member 130 and the handle body 132 mate together differently than those of the handle assembly 14.

Figure 21:
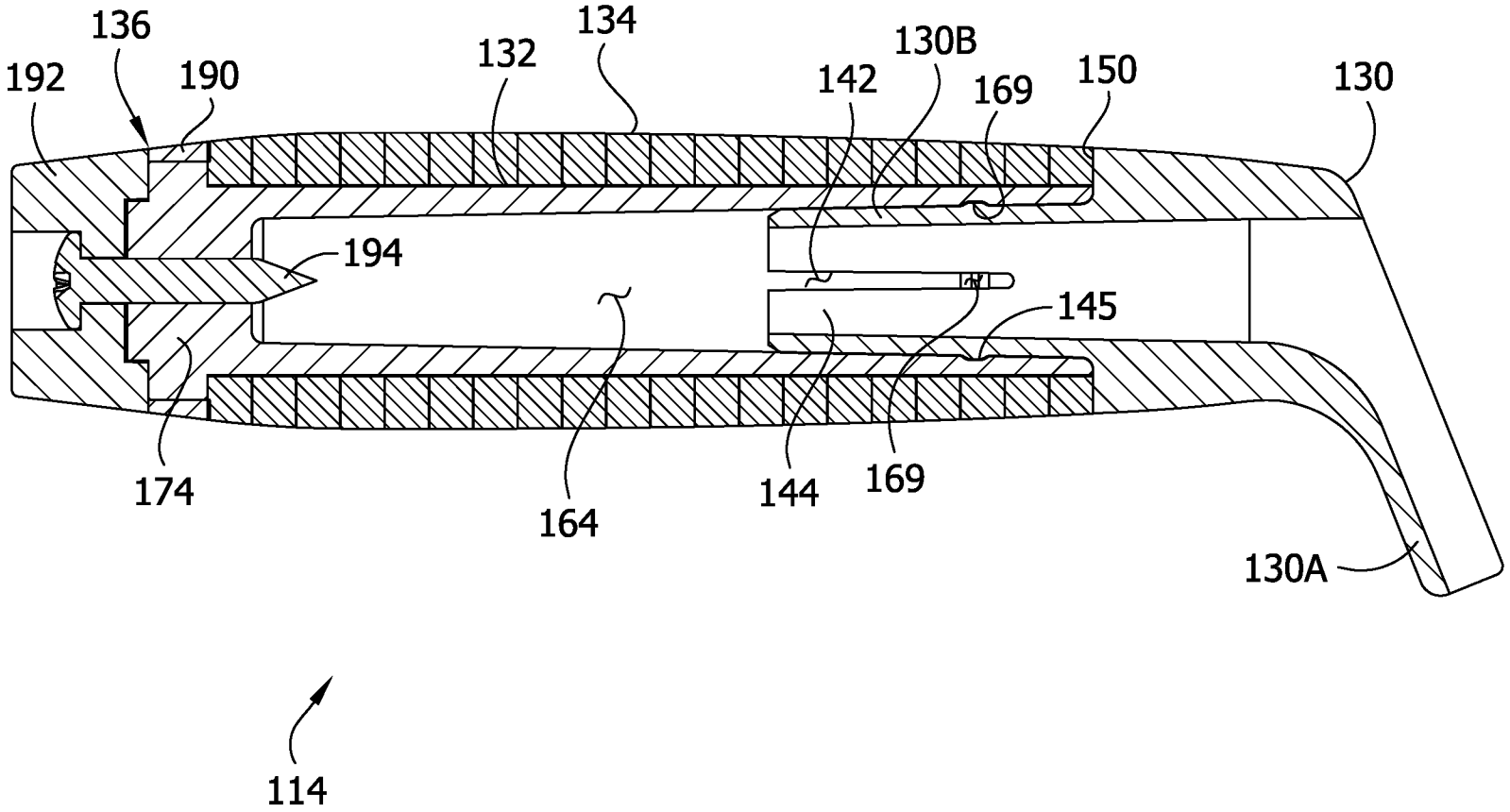
FIG. 21 is a section taken in the plane of line 21-21 of FIG. 19.
Figure 22:
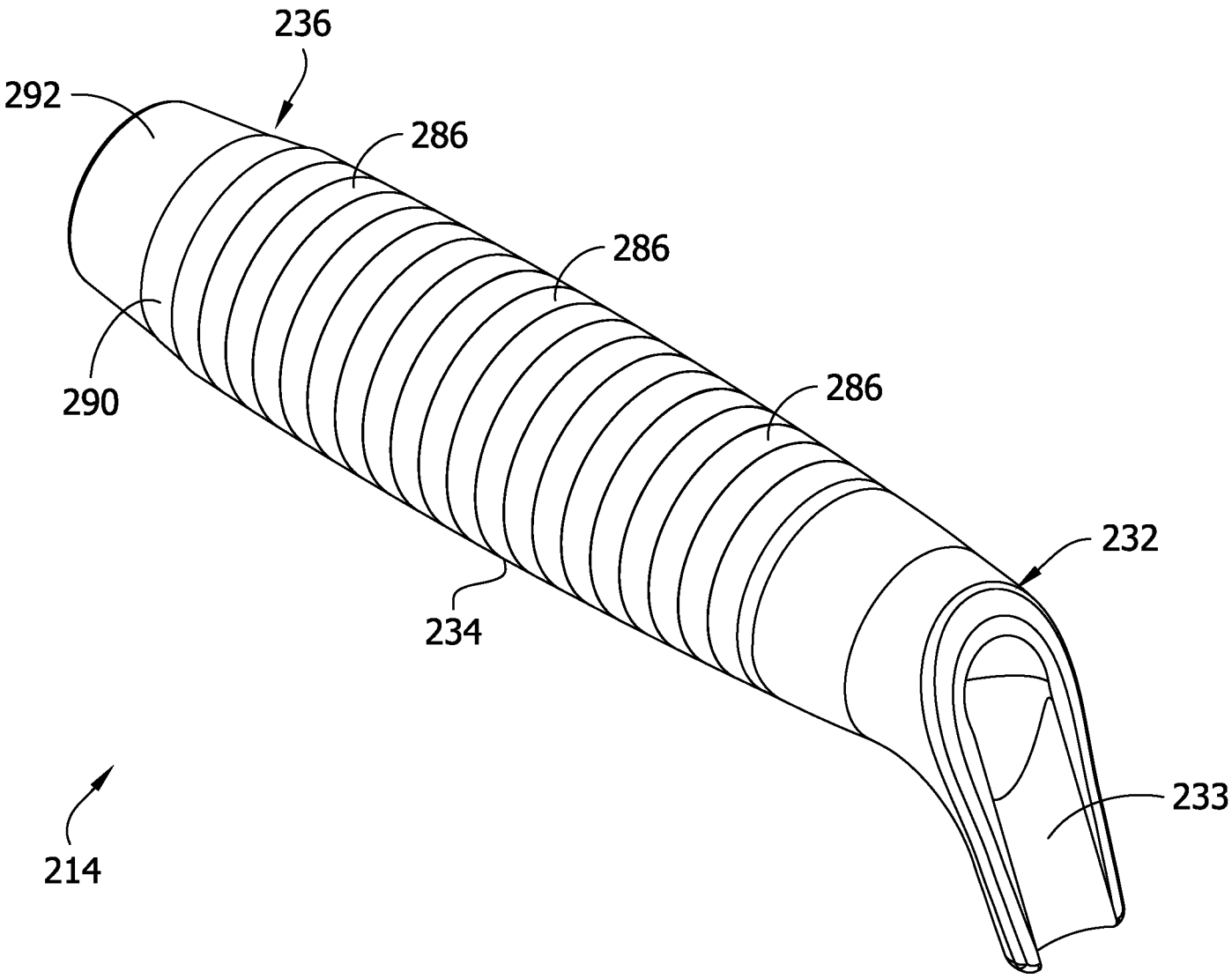
FIG. 22 is a perspective of another handle assembly.
Figure 23:
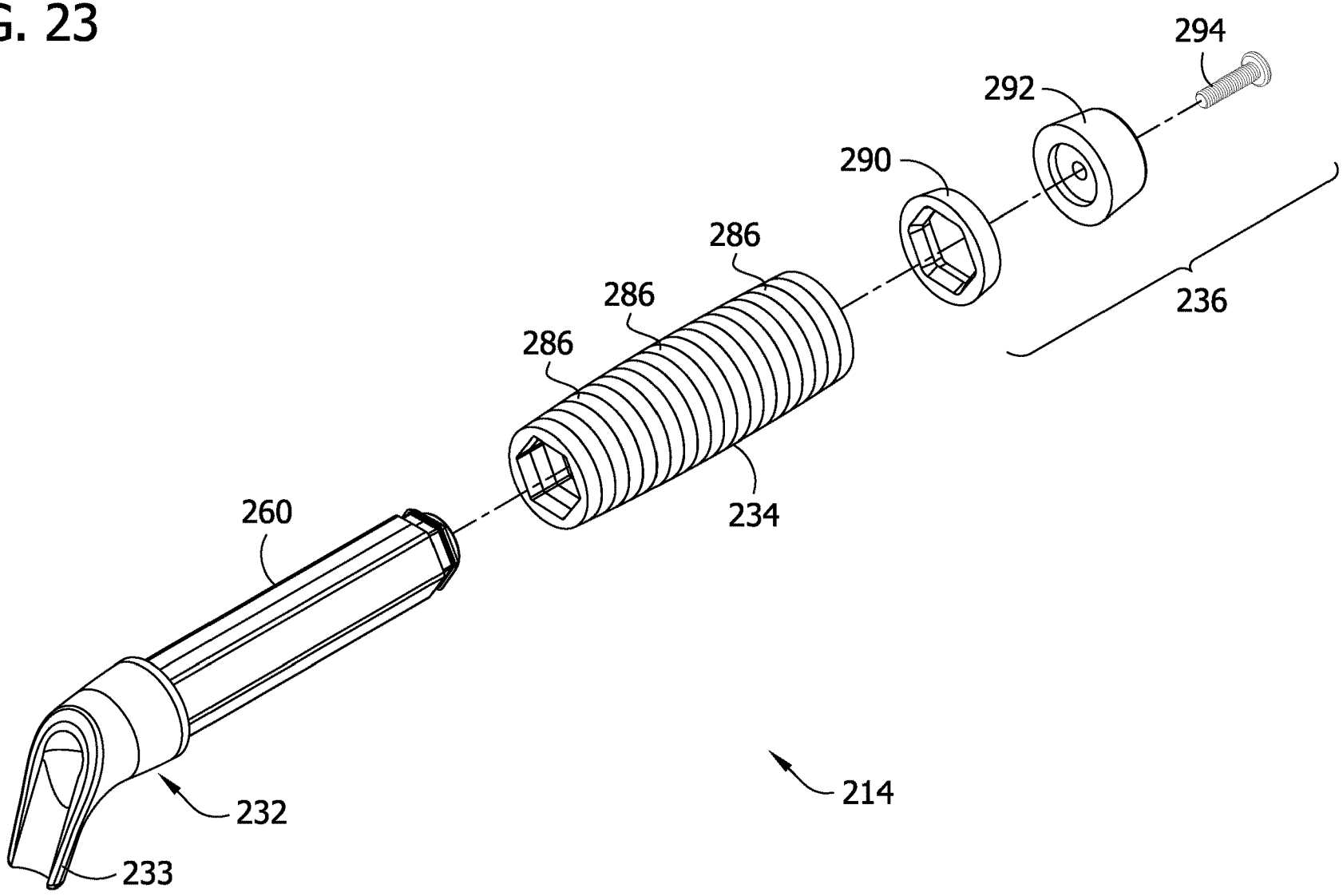
FIG. 23 is an exploded perspective of the handle assembly of FIG. 22.
Figure 24:
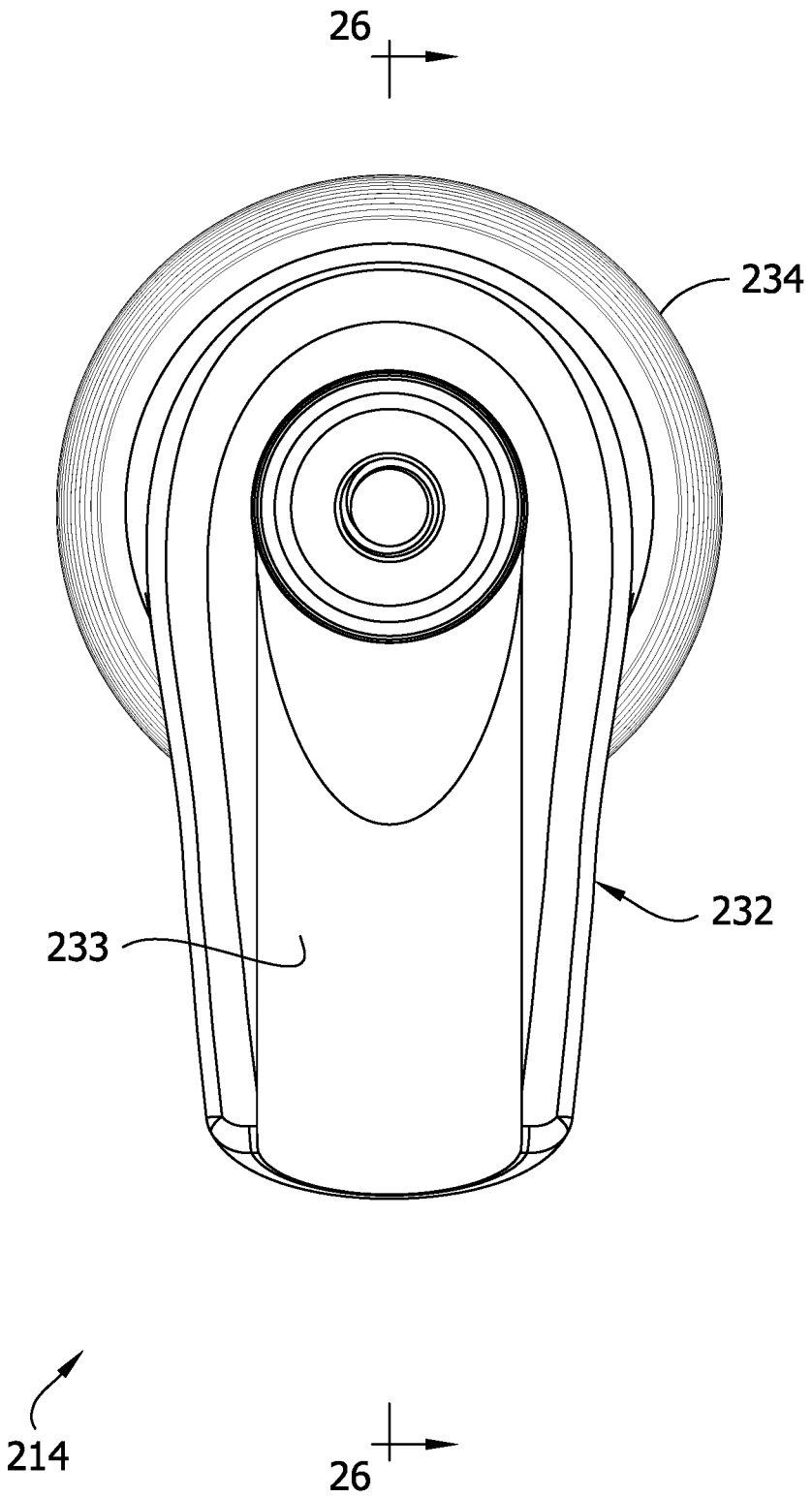
FIG. 24 is an end elevation of the handle assembly of FIG. 22.
Figure 25:
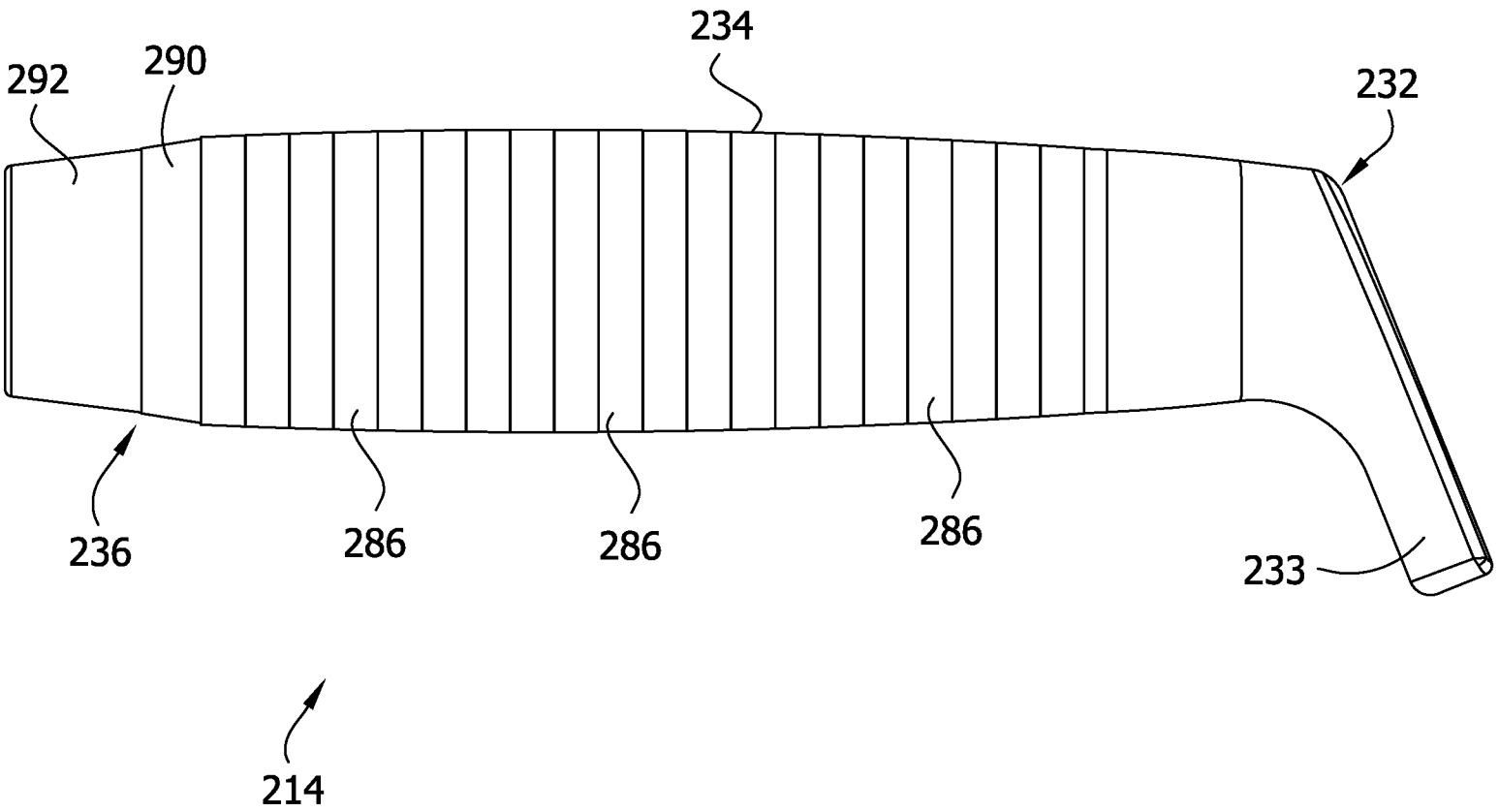
FIG. 25 is a side elevation of the handle assembly of FIG. 22.
Figure 26:
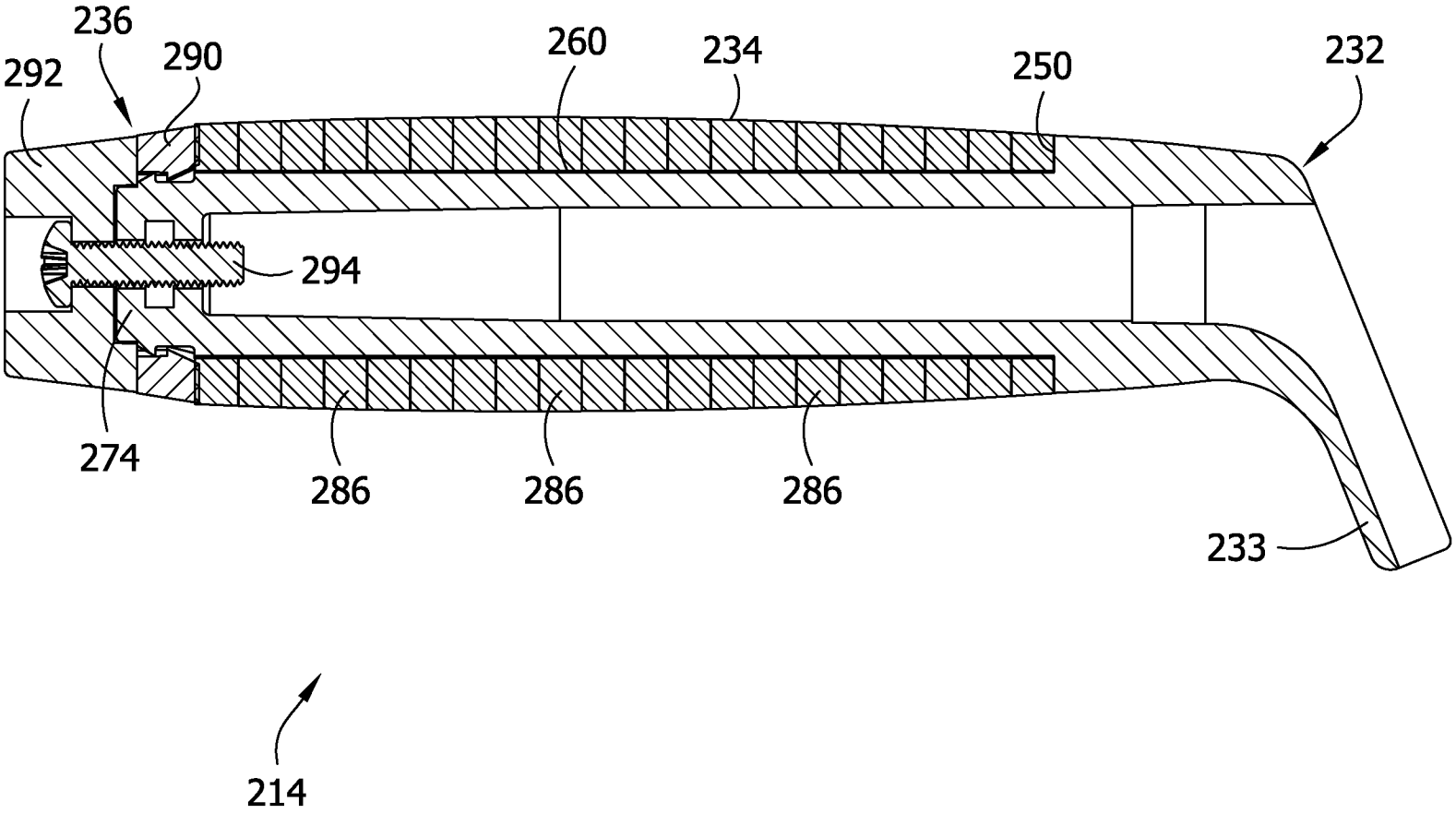
FIG. 26 is a section taken in the plane of line 26-26 of FIG. 24.

Like the nose member 30, the nose member 130 defines a plug 130B that is configured for mating engagement with a socket 164 of the handle body 132. The plug 130B is a generally annular body that extends proximally from a stop 150 defined by a finger guard 130A of the nose member 130. The plug 130B includes two slots 142 that extend radially through the annular wall of the plug at diametrically opposed locations. Each of the slots 142 extends axially from a distal end that is spaced apart proximally from the stop 150 through the proximal end of the plug 130B. The fingers 144 are configured to resiliently deflect radially inward toward one another as the plug 130B is being inserted into the socket 164. As above, the plug includes two tenons 148 that extend radially outward from the distal base portion of the plug at diametrically opposed positions that are circumferentially aligned with the slots 142. The plug 130B also includes an annular projection 145. In the illustrated embodiment, the annular projection 145 is located on the fingers 144 adjacent the distal ends of the slots 142. The annular projection 145 has a curved (e.g., semicircular) cross sectional shape as shown in FIG. 21. It will be understood that other embodiments can include annular projections that have different positions or shapes.

The handle body 132 is configured to receive the plug 130B in the socket 164 so that the plug and handle body form a press fit connection. The inner surface of the handle body 132 has a circumference that is slightly smaller than the outer circumference of the plug 130B. The inner surface of the handle body also defines mortices 170 for receiving the tenons 148. The tenons 148 fit within the mortices 170 as described above to fix the handle body 132 to the nose member 130 and ensure proper circumferential alignment of the nose member and handle body. The inner surface of the handle body 132 also defines an annular groove 169 that shaped and arranged for receiving the annular projection 145 when the plug 130B is installed in the handle body. The annular groove 169 can have a cross-sectional shape similar to that of the projection 145. For example, in the illustrated embodiment, the groove 169 has a curved cross sectional shape that generally conforms to that of the annular projection 145. Suitably, the annular groove 169 can be dimensioned to form a press fit connection with the annular projection 145 when the plug 130B is received in the handle body 132. For example, the groove 169 can have slightly smaller radial dimensions than the projection 145 so that the projection is held in compression when received in the groove.

To assemble the handle assembly 114, the grip 134 is installed over the handle body 132, for example, by individually placing rings 186 on the handle body. With the grip 134 positioned on the handle body 132, the plug 130B of the nose member 130 is inserted into the socket 164. As the plug 130B is inserted into the socket 164, the fingers 144 deflect radially inward, toward one another. Suitably, the axial end surface 162 of the handle body can have a radiused inner edge to gradually deflect the fingers 14 inward as the projection 145 enters the socket 164. When the annular projection 145 engages the inner surface of the handle body 132, the fingers 144 deflect further inward to fit the projection in the socket 164. If the tenons 148 are not circumferentially aligned with the mortices 170 the handle body or nose member must be rotated so that the tenons slide into the mortices as the plug 130B is inserted. The plug 130B is inserted into the socket 164 until the projection 145 is received in the groove 169. When the projection 145 is received in the groove 169, the fingers 144 resiliently deflect radially outward so that the projection mates with the groove to form a press fit connection. Suitably, the handle body 164 holds the fingers in compression, even after the projection 145 is received in the groove 169. Thus, the plug 130B and handle body 132 form a strong press fit connection that securely fixes the handle body on the nose member 130.

Referring to FIGS. 22-26, another embodiment of a handle assembly suitable for being mounted on the trowel blade 12 is generally indicated at 214. The handle assembly 214 is similar in many respects to the handle assembly 14. Corresponding features are given corresponding reference numbers, plus 200. In the illustrated embodiment, the nose member and the handle body are formed together in a one-piece handle body 232. For example, the handle body 232 can be formed of one piece of high strength plastic material ((e.g., a fiber reinforced polymer, polypropylene, glass filled polypropylene, polyamide, glass filled polyamide, etc.). Suitable materials may have water resistance, chemical resistance, conductive properties, high strength, high hardness and/or elasticity. In other embodiments, the handle body 232 can be formed of metal, wood, ceramic, composite, or other high strength material. Suitably, the handle body 232 may be molded part, such as an injection molded part. The handle body 232 can also be partially or fully formed in a machining process.

The handle body 232 includes a nose portion 233 that defines a finger guard 233 and a grip support portion 260 configured to mount a grip 234 on the handle body to inhibit rotation relative to the handle body. The grip support portion 260 extends proximally from an axial facing stop 250 to the proximal end of the handle body 232. There is no flange or other radially projecting structure along the length of the grip support projection 260. The grip 234 is, therefore, installed over the grip support portion 260 by sliding the grip onto the handle body 232 in the distal direction, for example, by individually placing rings 286 on the handle body. When the grip 234 is positioned over the grip support portion 260, a bumper assembly 236 can be installed to prevent the grip from sliding proximally relative to the handle body 232. As above, the bumper assembly 236 includes a spacer ring 290, a bumper member 292, and a screw 294. The screw 294 is threaded into a bumper mount 274 of the handle body 232 to secure the bumper member 292 and spacer ring 190 to the handle body. As explained above, the screw 294 forces the bumper member 292 against the spacer ring 290 and thereby presses the spacer ring against the proximal end of the grip 234 to compress the grip against the stop 250. This ensures tight-fitting engagement between the grip 234 and grip support portion 260.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A handle assembly for a trowel comprising:

an elongate handle body configured to be mounted on a blade of the trowel, the handle body having an outer grip support surface having an equilateral polygonal cross-sectional shape; and a grip mounted on and surrounding the handle body to provide a grip surface for a user of the trowel, the grip including a plurality of individual rings positioned end-to-end on the handle body, the plurality of individual rings defining an interior passage having an equilateral polygonal cross-sectional shape, wherein the outer grip support surface is received in the interior passage defined by the plurality of rings such that an entirety of the plurality of individual rings mates with and engages the outer grip support surface having the equilateral polygonal cross-sectional shape to inhibit rotation of the grip relative to the handle body.

2. A handle assembly as set forth in claim 1, wherein the handle body comprises plastic.

3. A handle assembly as set forth in claim 2, wherein the handle body comprises a one-piece, molded component.

4. A handle assembly as set forth in claim 1, wherein the polygonal cross-sectional shapes of the outer grip support surface and the passage are hexagonal cross-sectional shapes.

5. A handle assembly as set forth in claim 1, wherein the outer grip support surface has a length, the outer grip support surface having the polygonal cross-sectional shape generally along the entirety of its length.

6. A handle assembly as set forth in claim 1, further comprising proximal and distal axial grip supports configured to engage the axial ends of the grip and thereby hold the grip in compression on the handle body.

7. A handle assembly as set forth in claim 1, wherein the rings are resiliently deformable.

8. A handle assembly as set forth in claim 1, further comprising a nose member configured for mounting the handle body on the trowel blade.

9. A handle assembly as set forth in claim 8, wherein the nose member comprises a plug configured to be matingly received in a socket of the handle body.

10. A handle assembly as set forth in claim 8, wherein the nose member comprises plastic.

11. A handle assembly as set forth in claim 8, wherein the nose member comprises a one-piece, molded component.

12. A handle assembly as set forth in claim 8, wherein the nose member defines a finger guard.

13. A handle assembly as set forth in claim 8, wherein the nose member defines an axial grip support.

14. A handle assembly as set forth in claim 8, further comprising a bumper assembly mounted on a proximal end portion of the handle body.

15. A handle assembly as set forth in claim 14, wherein the bumper assembly comprises a spacer ring, a bumper member, and a screw.

16. A handle assembly as set forth in claim 15, wherein the screw is threaded into a bumper mount defined by the handle body and thereby fastens the bumper member to the handle body and press the spacer ring against a proximal axial end of the grip.

17. A handle assembly as set forth in claim 1, wherein the handle body is a one-piece component that defines a grip support portion and a finger guard.

18. A handle assembly as set forth in claim 1, in combination with the blade of the trowel.

19. A handle assembly for a trowel comprising:

an elongate handle body configured to be mounted on a blade of the trowel, the handle body having an outer grip support surface having a polygonal cross-sectional shape;

a grip mounted on and surrounding the handle body to provide a grip surface for a user of the trowel, the grip including a plurality of individual rings positioned end-to-end on the handle body the grip comprising an inner surface defining a passage extending through the grip and having a polygonal cross-sectional shape, wherein the passage of the grip and the outer grip support surface of the handle body are shaped and arranged for complementary mating engagement to inhibit rotation of the grip relative to the handle body; and a bumper assembly mounted on a proximal end portion of the handle body, the bumper assembly comprising a spacer ring, a bumper member, and a screw, the spacer ring defining an opening having a polygonal cross-sectional shape, wherein the opening of the spacer ring and the outer grip support surface of the handle body are shaped and arranged for complementary mating engagement to inhibit rotation of the spacer ring relative to the handle body.

20. A handle assembly as set forth in claim 19, wherein the screw is threaded into a bumper mount defined by the handle body and thereby fastens the bumper member to the handle body and press the spacer ring against a proximal axial end of the grip.

* * * * *